US006283569B1

(12) United States Patent
Otsuka et al.

(10) Patent No.: US 6,283,569 B1
(45) **Date of Patent: *Sep. 4, 2001**

(54) RECORDING METHOD USING LARGE AND SMALL DOTS

(75) Inventors: Naoji Otsuka, Yokohama; Kiichiro Takahashi, Kawasaki; Hitoshi Nishikori, Inagi; Osamu Iwasaki, Tokyo; Noribumi Koitabashi, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/882,033

(22) Filed: Jun. 25, 1997

(30) Foreign Application Priority Data

Jun. 27, 1996 (JP) ..... 8-167752
Jun. 9, 1997 (JP) ..... 9-151359

(51) Int. Cl.[7] ..... B41J 2/205
(52) U.S. Cl. ..... 347/15
(58) Field of Search ..... 347/15, 62, 19, 347/40, 43, 41, 35, 37

(56) References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,631,548 | 12/1986 | Milbrandt | 346/1.1 |
| 4,683,492 | 7/1987 | Sugiura et al. | 358/80 |
| 4,723,129 | 2/1988 | Endo et al. | 346/1.1 |
| 4,740,796 | 4/1988 | Endo et al. | 346/1.1 |
| 5,140,339 | 8/1992 | Higuma et al. | 346/1.1 |
| 5,142,374 | 8/1992 | Tajika et al. | 358/298 |
| 5,146,236 * | 9/1992 | Hirata et al. | 347/15 |
| 5,459,502 | 10/1995 | Sakaki et al. | 347/100 |
| 5,477,245 | 12/1995 | Fuse | 347/10 |
| 5,488,398 | 1/1996 | Matsubara et al. | 347/43 |
| 5,610,637 * | 3/1997 | Sekiya et al. | 347/15 |
| 5,617,123 * | 4/1997 | Takaoka et al. | 347/15 |
| 5,754,201 * | 5/1998 | Ishinaga et al. | 347/62 |

FOREIGN PATENT DOCUMENTS

| | | |
|---|---|---|
| 0 628 415 | 12/1994 | (EP) . |
| 0 707 963 | 4/1996 | (EP) . |
| 54-56847 | 5/1979 | (JP) . |
| 59-123670 | 7/1984 | (JP) . |
| 59-138461 | 8/1984 | (JP) . |
| 60-71260 | 4/1985 | (JP) . |
| 8-156310 | 6/1996 | (JP) . |
| 9-118025 | 5/1997 | (JP) . |

* cited by examiner

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

An ink jet recording apparatus and method for recording an image on a recording medium by ejecting ink from each of a plurality of recording elements of a recording head is provided. The apparatus includes an ink ejection amount changing unit for changing an ink ejection amount of each recording element of the recording head, a timing controller for controlling an ink ejection timing of the ink ejection amount changing unit, a modulator for modulating record data, and a controller for controlling to record an image on the recording medium by outputting the record data modulated by the modulator synchronously with an ejection timing determined by the timing controller.

54 Claims, 24 Drawing Sheets

| INPUT (2-BIT) | OUTPUT (DECODED) | |
|---|---|---|
| 00 | × | × |
| 01 | × | ○ |
| 10 | ◯ | × |
| 11 | ◯ | ○ |

$$f L \cdot \frac{v1-v2}{v1v2} = 0$$

$$f L \cdot \frac{v1-v2}{v1v2} = 0.25$$

$$f L \cdot \frac{v1-v2}{v1v2} = 0.5$$

$$f L \cdot \frac{v1-v2}{v1v2} = 0.75$$

$$f L \cdot \frac{v1-v2}{v1v2} = 1.0$$

PIXEL LENGTH

0

-0.5

0.5

RECORDING METHOD USING LARGE AND SMALL DOTS

BACKGROUND OF THE INVENTION

1. Field of the Invention

The present invention relates to an ink jet recording method and apparatus and an ink jet recording head, in which recording is preformed by ejecting ink out of a recording head and applying it to recording medium.

2. Related Background Art

In recording apparatuses such as printers, copiers, and facsimiles, dots are recorded with recording elements (such as nozzles, heating elements and wires) on recording medium such as paper and plastic thin plate in accordance with image information to thereby record an image composed of dots. Such recording apparatuses are classified based on their recording methods, into an ink jet type, a wire dot type, a thermal type, a laser beam type, and the like. Of these types, the ink jet type (ink jet printer) records an image by ejecting ink (recording liquid) out of an ejection port (nozzle) of a recording head and blowing it onto recording medium.

A number of recording apparatuses are used nowadays with output terminals such as personal computers and image processing apparatuses. These recording apparatuses are required to have functions of high speed recording, high resolution, high image quality, low noises and the like. One example of recording apparatuses which can meet such requirements is an ink jet recording apparatus. Since an ink jet recording apparatus performs recording by ejecting ink out of a recording head, non-contact recording relative to recording medium is possible so that a very stable record image can be formed.

With recent advent of various types of digital cameras, digital camcoders, CD-ROM's and the like, pictorial image data can now be easily processed by applications running on a host computer. Under these circumstances, a performance of outputting pictorial images is required for output apparatuses such as printers. Conventionally, a pictorial image has been recorded by a highly sophisticated silver salt type recording apparatus which uses digital image input or an expensive sublimation type recording apparatus which is limited only to photographic output generated by using sublimation dye.

Conventional such recording apparatuses dedicated to photographic images are very expensive. One reason is a very complicated process of the silver salt type and a large size unsuitable for desk-top use. Another reason is use of sublimation dye by the sublimation type apparatus, which results in a larger cost of the apparatus and its larger running cost as the size of recording medium becomes larger. These conventional recording apparatuses are too expensive for general users. The most significant disadvantage is that design of such apparatuses assumes use of specific recording medium. Therefore, these apparatuses are not suitable for use shared by general persons and professionals. It is very cumbersome and difficult to discriminately use between plain paper sheets and specific recording sheets in order to record graphic originals formed by a word processor and pictorial photographic originals.

An ink jet printer is known as a recording apparatus which reduces such limitations on recording media. In order to solve the above problems associated with such ink jet printers, image processing, coloring agents and recording media have been improved and a photographic image with a considerably improved quality can now be printed.

Several studies have been made in order to improve the tonal level of a color graphic output. For example, those improvements proposed recently in practical use include a record resolution improved more than a normal color recording mode to provide a better drawing capability, a multi-value output using sub-pixels with an improved record resolution, and the like.

Another practical recording method is to uniformly reduce an amount of ejected ink during a high resolution mode by changing an ink ejection amount of a recording head. Recording heads such as those capable of modulating an ink ejection amount at each nozzle have also been proposed.

The above-described conventional recording methods are associated with, however, the following problems.

(1) The method of uniformly reducing ink jet amount records an image at a higher resolution both in the main and subsidiary scan directions. Therefore, the number of main scans increases and the feed amount in the sub-scan direction reduces so that the recording speed lowers greatly. As the resolution of recording data is raised, the data amount increases greatly which results in a large increase of the memory capacity, increased data transfer amount and time required by interface, an increase of load of a printer driver, and the like. For example, if the resolution of record data is increased by two times, the data amount is doubled for both in the main and sub-scan directions so that the total data amount is a square of 2 or four times. Since recording dots are made fine in order to suppress a granular image quality (irregular image quality) at a low density area, a number of fine dots are also recorded at the high density area although in this area the granular image quality does not become conspicuous. Although the total image quality can be improved, an image forming efficiency is not improved correspondingly.

(2) Another recording method is to use a combination of large and small dots. This method can improve an image forming efficiency. This method can be applied easily if one recording nozzle is used for each color. However, if a plurality of nozzles are used for each color, this method becomes difficult as the number of nozzles increases. Ejection of ink droplets from each nozzle is generally performed at several KHz or higher. If the number of nozzles is small, these nozzles can be controlled directly by a CPU. However, as the number of nozzles increases, it becomes necessary to use hardware such as gate array circuits in addition to the operation of CPU in view of a processing speed. In order to modulate the ink ejection amount of large and small dots, either an ejection drive pulse is modulated or an ejection drive element in a nozzle is changed.

If the ejection element is to be changed, it is necessary to provide the recording head with registers for large and small dots. The number of necessary registers is an integer multiple relative to a record resolution so that the circuit scale of the recording head becomes large and the cost of the recording head rises. If the drive pulse is to be modulated, signal lines are required for independently controlling respective nozzles. As opposed to one signal line, several hundreds of signal lines (as many as the number of nozzles) are required. In this case, other elements such as signal line contacts, a flexible cable to the recording head, recording element driver transistors and the like are also required, leading to increased cost.

If a combination of large and small dots is not recorded during one scan of a recording head, the recording head must be scanned several times for a large dot scan and a small dot scan. With this method, a combination of large and small dots can be recorded with simple circuit structure. However, this method necessarily requires a plurality of scans (hereinafter called multi-path scan). For example, even if small dots are recorded at most of addresses during one scan and only one large dot is recorded during this one scan, a total of two recording scans is necessary irrespective of only one large dot. Furthermore, as the number of multi-path scans or records increases, the record time prolongs so that it is necessary to minimize the number of multi-path records. In this connection, consider that a gradation from low density (white) to high density (black) is reproduced with a two-path record. Recording starts first from the smallest dots when color (including grey scale) develops after the low density area. As the image density increases, small dots are sequentially recorded at available lattice points (virtual record dot positions). After small dots are recorded fully, an image is recorded with mixed dots of large and small dots, and as the image density further increases, large dots are additionally recorded to the maximum density.

For the above record control, the recording apparatus is configured so that large and small dots are recorded alternately between respective multi-path scans. Recording under these conditions may result in a wasteful scan if there is no large dot to be recorded because of small dots recorded at all available lattice points. In addition to this problem, the prevention effect of so-called banding which is characteristic to the multi-path divisional recording is lost, because the recording is performed 100% only by small dots during one scan of the two-path scans. The banding is phenomena of variation of ejection amounts of recording nozzles, and variation of paper feed amounts and the like. Still further, since the record ratio between scans is not uniform, several problems occur such as an inability of lowering an error rate during a scan with a higher record ratio because of different record ratios, an inability of lowering consumption power because of a high instantaneous power during a scan with a higher record ratio, and the like.

SUMMARY OF THE INVENTION

It is an object of the present invention to provide an ink jet recording method and apparatus and an ink jet recording head, capable of recording an image with different tonal levels in accordance with record data.

It is another object of the present invention to provide an ink jet recording method and apparatus and an ink jet recording head, capable of modulating a dot diameter during one scan with a simple structure.

It is a further object of the present invention to provide an ink jet recording method and apparatus and an ink jet recording head, capable of easily recording an image by using the same data control algorithm even for multi-path record.

It is a still further object of the present invention to provide an ink jet recording method and apparatus, capable of improving an image quality by recording ink droplets which form dots having different diameters, at generally the same pixel position.

In order to achieve the above objects, an ink jet recording apparatus of this invention for recording an image on a recording medium by ejecting ink from each of a plurality of recording elements of a recording head, comprises: ink ejection amount changing means for changing an ink ejection amount of each recording element of the recording head; timing control means for controlling an ink ejection timing of the ink ejection amount changing means; modulating means for modulating record data; and control means for controlling to record an image on the recording medium by outputting the record data modulated by the modulating means synchronously with an ejection timing determined by the timing control means.

In order to achieve the above objects, an ink jet recording method of this invention for recording an image on a recording medium by ejecting ink from each of a plurality of recording elements of a recording head, comprises the steps of: modulating record data; and recording an image on the recording medium by outputting the record data modulated at the modulating step synchronously with an ink ejection timing of each recording element of the recording head having a different ink ejection amount.

In order to achieve the above objects, an ink jet recording head of this invention for recording a pixel with a plurality of dots by ejecting ink from an ink ejection port, comprising: driving means for sequentially ejecting, at predetermined timings, at least two inks among a plurality of inks forming a plurality of dots constituting the pixel, from the ink ejection port; changing means for changing the ink ejection amounts of at least two inks sequentially ejected from the recording head by the driving means at the predetermined timings; and output means for outputting, time sequentially and synchronously with the predetermined timings, data for ejecting ink which forms the pixel and contains information of ink ejection amounts in the ink output order.

DETAILED DESCRIPTION OF THE PREFERRED EMBODIMENTS

Preferred embodiments of the invention will be detailed with reference to the accompanying drawings.

Figure 1:
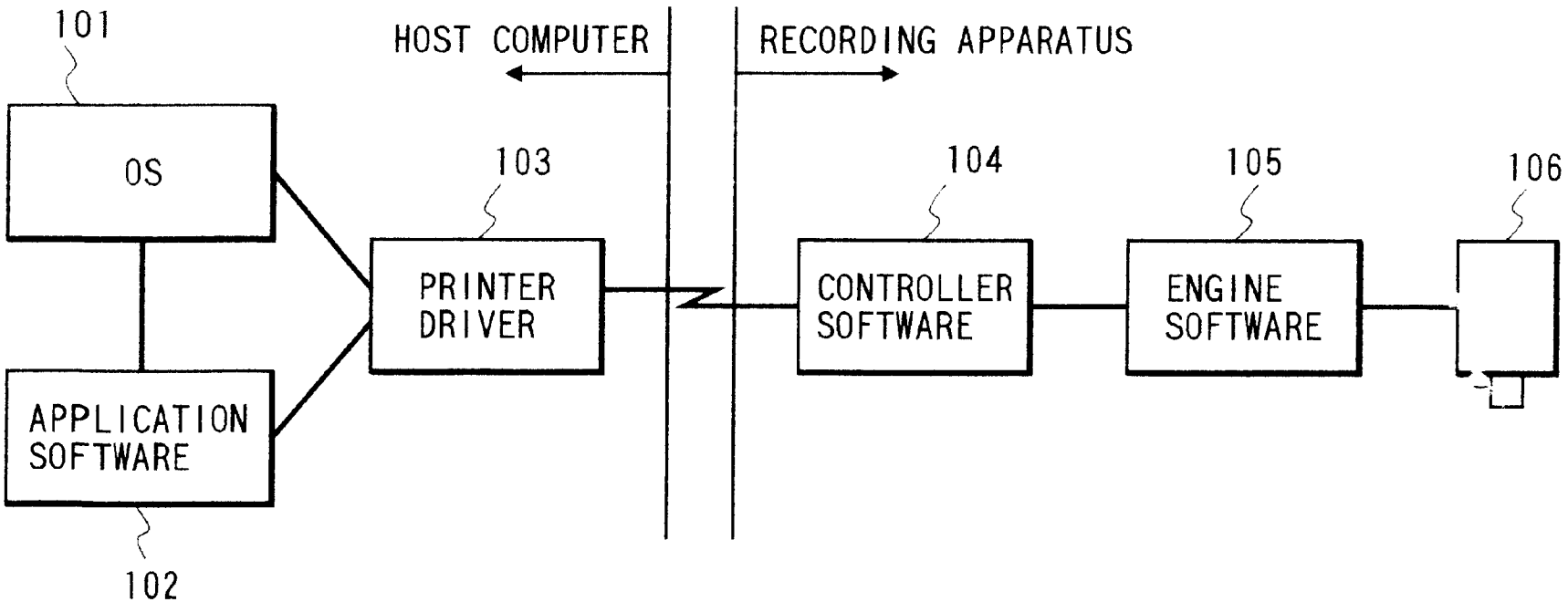
FIG. 1 is a block diagram showing the structure of a host computer and a printing system having a printer according to an embodiment of the invention.

FIG. 1 is a block diagram showing the structure of a printer system according to an embodiment of the invention.

In FIG. 1, a host computer is generally configured so that various data is processed by application software 102 running on an OS (operating system) 101. A data flow will be described by taking as an example the case wherein by using the application software 102, image data is output via a printer driver 103 to a printer to print it out.

Image data processed by the application software 102 is pictorial image data, and is sent as multi-value RGB data to the printer driver 103. The printer driver color-processes the multi-value RGB data received from the application software 102, and half-tone-processes it to convert it into two sets of CMYK data in an ordinary case. The converted image data is output via printer interface of the host computer or via interface of a storage device such as a file. In the example shown in FIG. 1, image data is output via the interface of the printer to a printer.

Under the control of controller software 104, the printer receives the image data and checks integrity with a print mode and an ink cartridge or the like. Thereafter, the received image data is transferred to engine software 105. The engine software 105 receives the image data having a print mode and a data structure designated by the controller software 104, and in accordance with the image data, generates an ink ejection pulse which is output to a head cartridge 106.

The head cartridge 106 ejects ink having a corresponding color to record a color image corresponding to the image data. The head cartridge 106 has an integral structure of ink tanks accommodating various color inks and a recording head.

Figure 2:
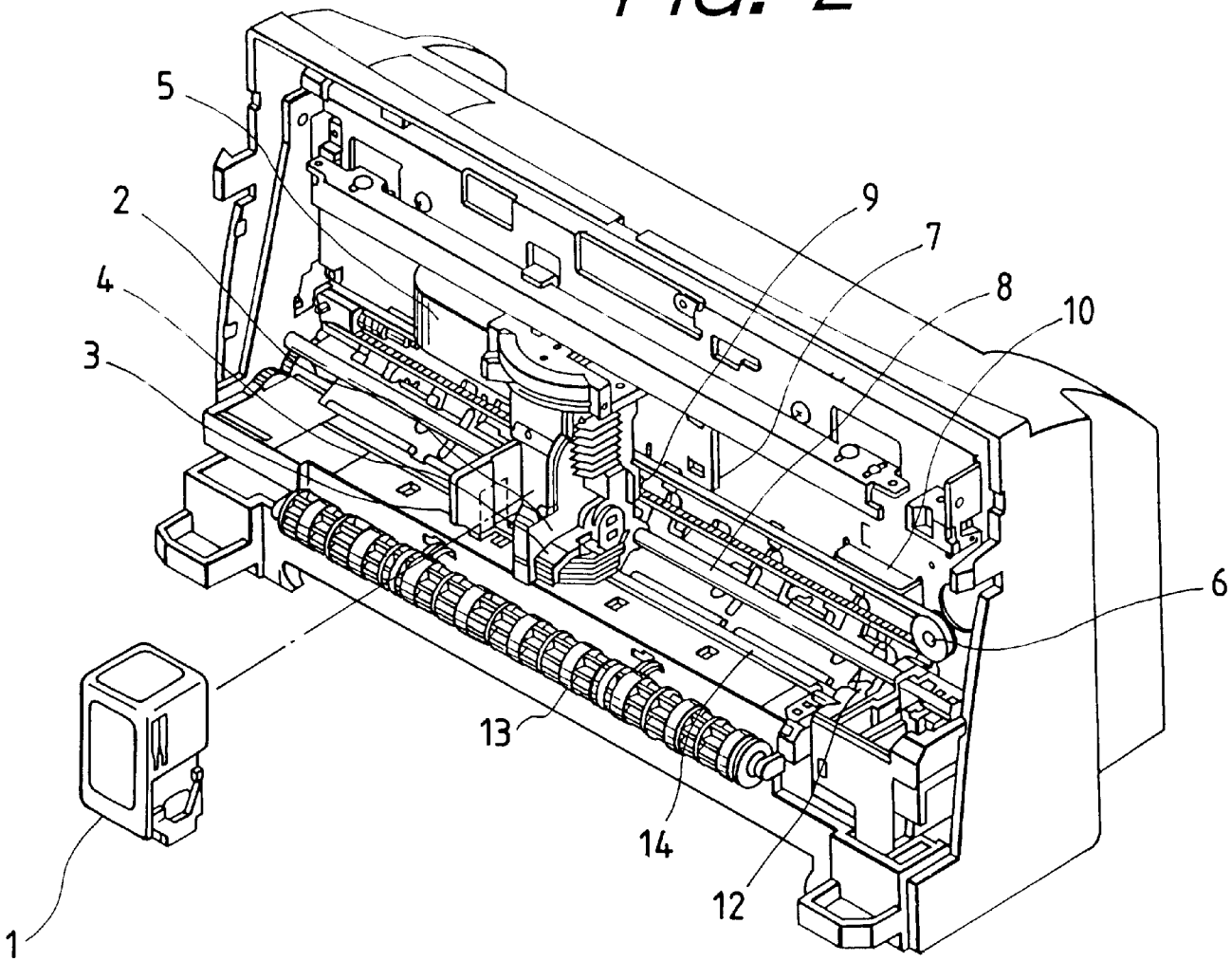
FIG. 2 is a perspective view of a record unit of a printer according to an embodiment of the invention.

FIG. 2 shows a mechanical structure of an ink jet recording apparatus 200 of a cartridge replaceable type according to an embodiment of the invention.

In FIG. 2, reference numeral 1 represents a replaceable type head cartridge (corresponding to the head cartridge 106 shown in FIG. 1). This cartridge 1 has an ink tank unit for accommodating inks and a recording head. Reference numeral 2 represents a carriage unit which loads the head cartridge 1 to move it right and left for recording. Reference numeral 3 represents a holder for fixing the head cartridge 1, the holder being operated in combination with a cartridge fixing lever 4. Namely, after the head cartridge 1 is loaded on the carriage unit 2, the cartridge fixing lever 4 is operated to press the head cartridge 1 against the carriage unit 2. In this manner, position alignment of the head cartridge 1 and electrical connection between the head cartridge 1 and carriage unit 2 can be established. Reference numeral 5 represents a flexible cable for transferring electrical signals to the carriage unit 2. Reference numeral 6 represents a carriage motor for reciprocally moving the carriage unit 2 in the main scan direction. Reference numeral 7 represents a carriage belt which is moved by the carriage motor to move the carriage unit 2 right and left. Reference numeral 8 represents a guide shaft for supporting the carriage unit 2 in a slide state. Reference numeral 9 represents a home position sensor having a photocoupler for determining the home position of the carriage unit 2. Reference numeral 10 represents a light shielding plate used for detecting the home position. The light shielding plate 10 shields the photocoupler mounted on the carriage unit 2 when this unit reaches the home position to thereby detect that the carriage unit 2 has reached the home position. Reference numeral 12 represents a home position unit including a recovery mechanism for the recording head of the head cartridge 1. Reference numeral 13 represents a paper ejection roller for ejecting recording medium. This paper ejection roller squeezes recording medium by using an unrepresented paper ejection spur unit to eject the recording medium out of the apparatus. Reference numeral 14 represents an LF unit for feeding recording medium in a sub-scan direction by a predetermined amount.

Figure 3:
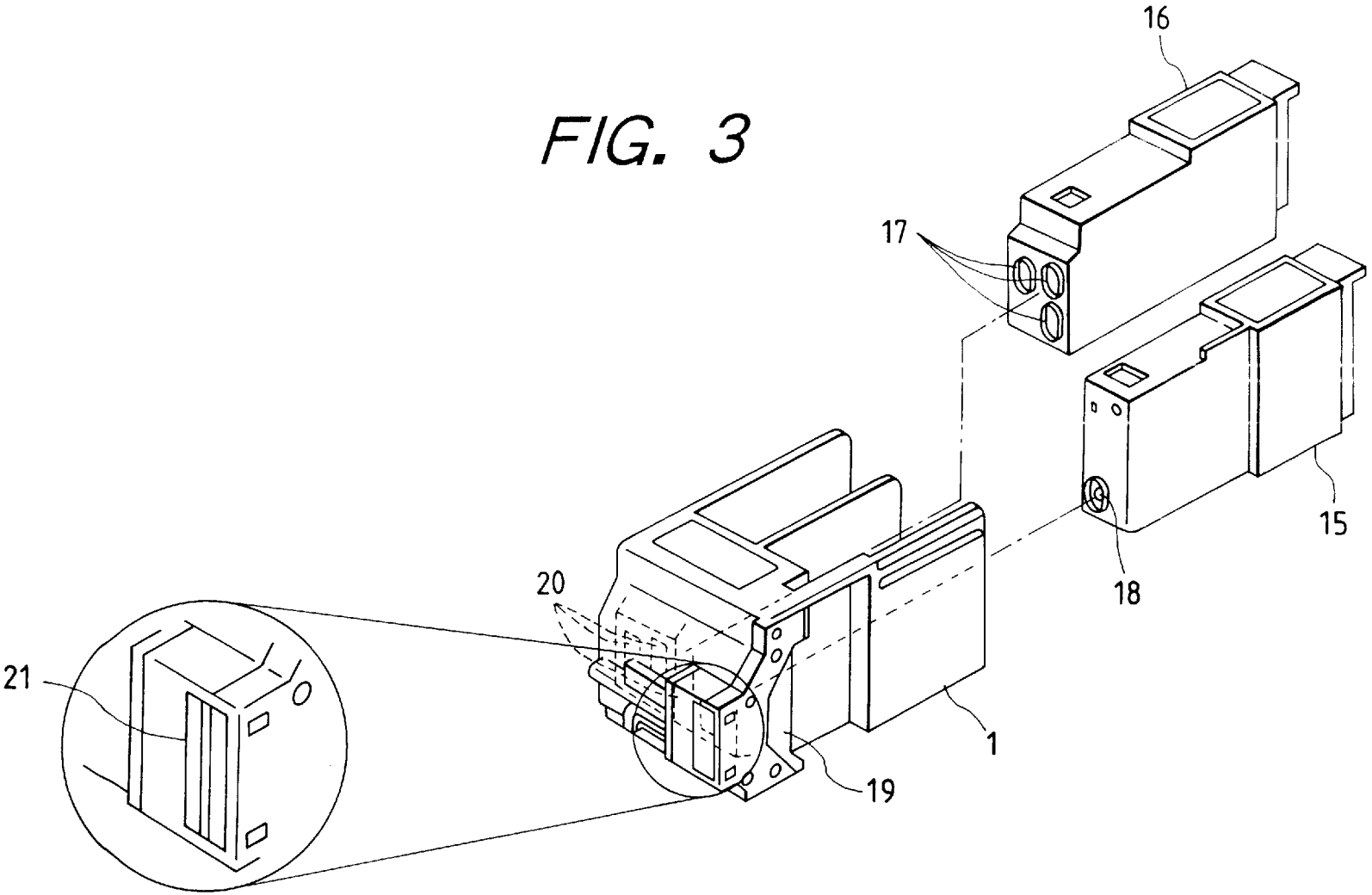
FIG. 3 is a perspective view of a head cartridge of the embodiment.

FIG. 3 is a detailed diagram of the head cartridge of this embodiment.

In FIG. 3, reference numeral 15 represents a replaceable ink tank of black (Bk) color. Reference numeral 16 represents replaceable ink tanks accommodating C, M and Y coloring inks. Reference numeral 17 represents a conduit (coloring agent supply port) for the ink tank 16, the conduit being communicating with the head cartridge 1 for the supply of coloring agents. Reference numeral 18 represents a conduit (coloring agent supply port) for the ink tank 15. The coloring agent supply ports 17 and 18 communicate with a supply tube 20 for the supply of coloring agents to a recording head unit 21. Reference numeral 19 represents an electrical signal contact portion which is connected to a flexible cable 5 (FIG. 2) to transfer various signals to the head cartridge 1.

Figure 4:
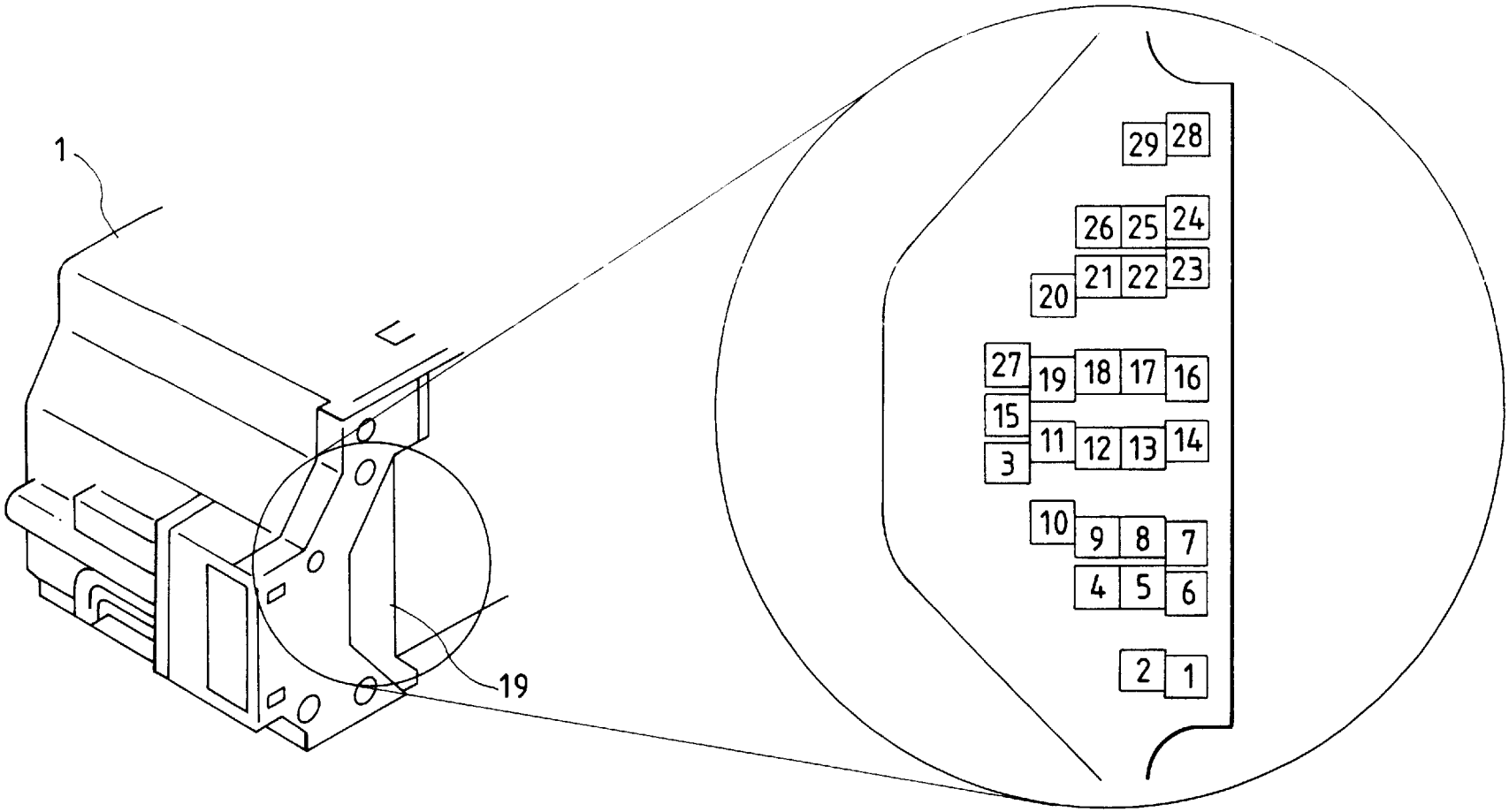
FIG. 4 is a diagram showing an electrical contact portion used for the electrical connection between the head cartridge and printer of the embodiment.

FIG. 4 is a detailed diagram of the contact portion 19 of the head cartridge 1.

This contact portion 19 is provided with a plurality of electrode pads via which an ink ejection signal, an ID signal for the head cartridge 1 and the like are transferred to and from the ink jet recording apparatus.

It is possible to check whether the head cartridge 1 was exchanged, by monitoring the conduction state of the contact portion 19 shown in FIG. 4.

Figure 5:
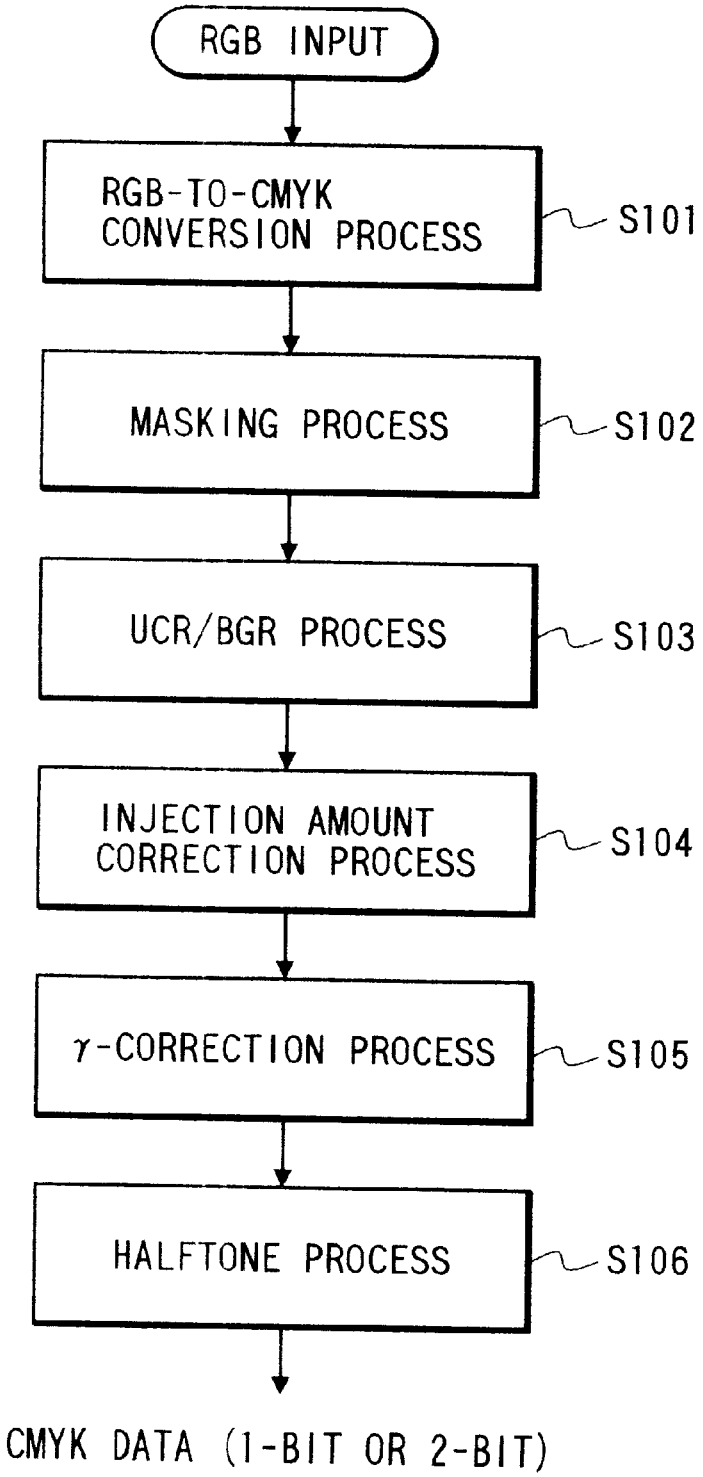
FIG. 5 is a flow chart illustrating a record data processing routine to be executed by a printer driver of the embodiment.

FIG. 5 is a flow chart illustrating an example of an image processing routine to be executed by an image processing module of the printer driver 103 of the embodiment.

At Step S101, a luminance/density conversion process is executed to convert RGB luminance signals of 24 bits constituted of 8 bits for each of R, G and B into CMY density signals of 24 bits constituted of 8 bits for each of C, M and Y or CMYK signals of 32 bits. Next, at Step S102 a masking process is executed to perform a correction process of correcting unnecessary color components of dyes of CMY coloring agents. At Step S103 an UCR/RGB process is executed to remove background color and derive black components. At Step S104 primary and secondary colors of each pixel are limited to different injection amounts. In this example, the primary color is limited up to 300% and the secondary color is limited up to 400%.

Next, at Step S105, an output gamma correction is executed to correct the output characteristics to be linear. Up to these Steps, a multi-value output of 8 bits for each color is used. Next, at Step S106 a half-tone process of 8-bit signal is executed to convert CMYK data of each color into a signal of one or two bits. The half-tone process at Step S106 is executed by an error diffusion method or dither method.

Figure 6:
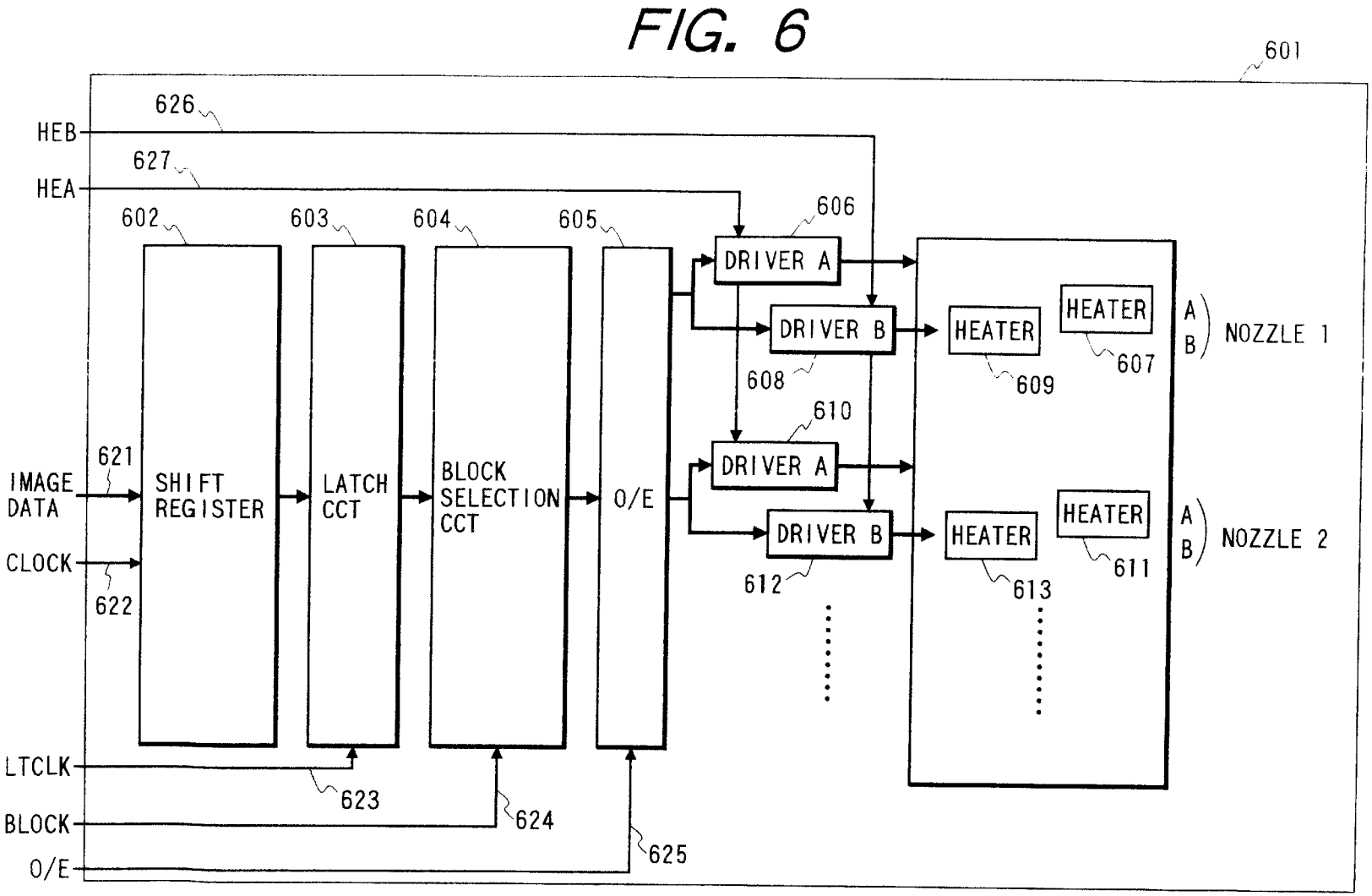
FIG. 6 is a block diagram showing the circuit structure of the head cartridge of the embodiment.

FIG. 6 is a block diagram showing a flow of an internal signal of the head cartridge of the printer of the embodiment. In this example, two ink ejection heaters having different heat generation amounts are provided for each nozzle. By changing a heater to be driven, the size (record dot size) of an ejected ink droplet is changed. A plurality of heat generation resistive members (heaters) may be provided for each nozzle, and by changing the number of heaters driven generally at the same time, the heat generation amount is controlled to thereby change the ejection amount. An ink jet method may be other methods such as a piezo jet method.

In FIG. 6, reference numeral 601 represents a heater board of the recording head. Image data 621 to be recorded is serially sent from the printer main body synchronously with a clock signal 622. This image data is transferred to a shift register 602 and held therein. As all image data to be recorded at one record period is transferred to and held in the shift register 602, a latch signal 623 is supplied from the recording apparatus main body. Synchronously with this latch signal 623, the data held in the shift register 602 is latched by a latch circuit 603. Next, the image data stored in the latch circuit 603 is divided into blocks each having a dispersed distribution of dots as designated one of various methods. In accordance with a block selection signal 624, an output of the latch circuit 603 is selected by a block selecting circuit 604 and output. Reference numeral 605 represents an odd/even selector for selecting either an odd number nozzle or an even number nozzle of the recording head in accordance with a selection signal 625. In this embodiment, one nozzle is provided with two ejection heaters A and B for large and small dots having large and small dot sizes. When an ink ejection amount is to be changed, a proper one of the heaters is selected. The shift register 602 and latch circuit 603 are preferably structured so that they can hold as many bits as twice the number of nozzles (in the case where one pixel is composed of two bits).

There are various types of methods for controlling the size of a dot to be recorded by the recording apparatus described above. In this embodiment, it is assumed that the dot size is changed in the following method. For example, as the ejection heater A 607 of the nozzle 1 is driven via a driver A 606 by a heat enable signal (HEA) 627, the ink amount ejected from the nozzle 1 becomes large to form a large dot, whereas the ejection heater B 609 of the nozzle 1 is driven via a driver B 608 by a heat enable signal (HEB) 626, the ink amount ejected from the nozzle 1 becomes small to form a small dot. Similarly, as an ejection heater 611 of the nozzle 2 is driven by a driver A 610, a large dot is formed, whereas as an ejection heater 613 is driven by a driver B 612, a small dot is formed.

The conditions of recording a dot at a designated position on recording medium by the recording apparatus constructed as above are as follows.

(1) A bit of each record data latched by the latch circuit 603 and corresponding to each ejection nozzle is "1" (data presence).

(2) The bit corresponds to the block selected by the block selecting signal 624.

(3) The selection signal 625 for an odd/even number nozzle corresponds to the nozzle position.

(4) A corresponding heat enable signals 626, 627 are input.

When the above four conditions are met, a corresponding one of the ejection heaters A and B is driven and a large or small dot is recorded. Specifically, depending upon whether the input heat enable signal is the HEB signal 626 or HEA signal 627, the dot diameter of an ink droplet ejected from the nozzle is determined, and depending upon at which block timing the record data is set to a high level "1", the position of the large or small dot is determined.

Figure 7:
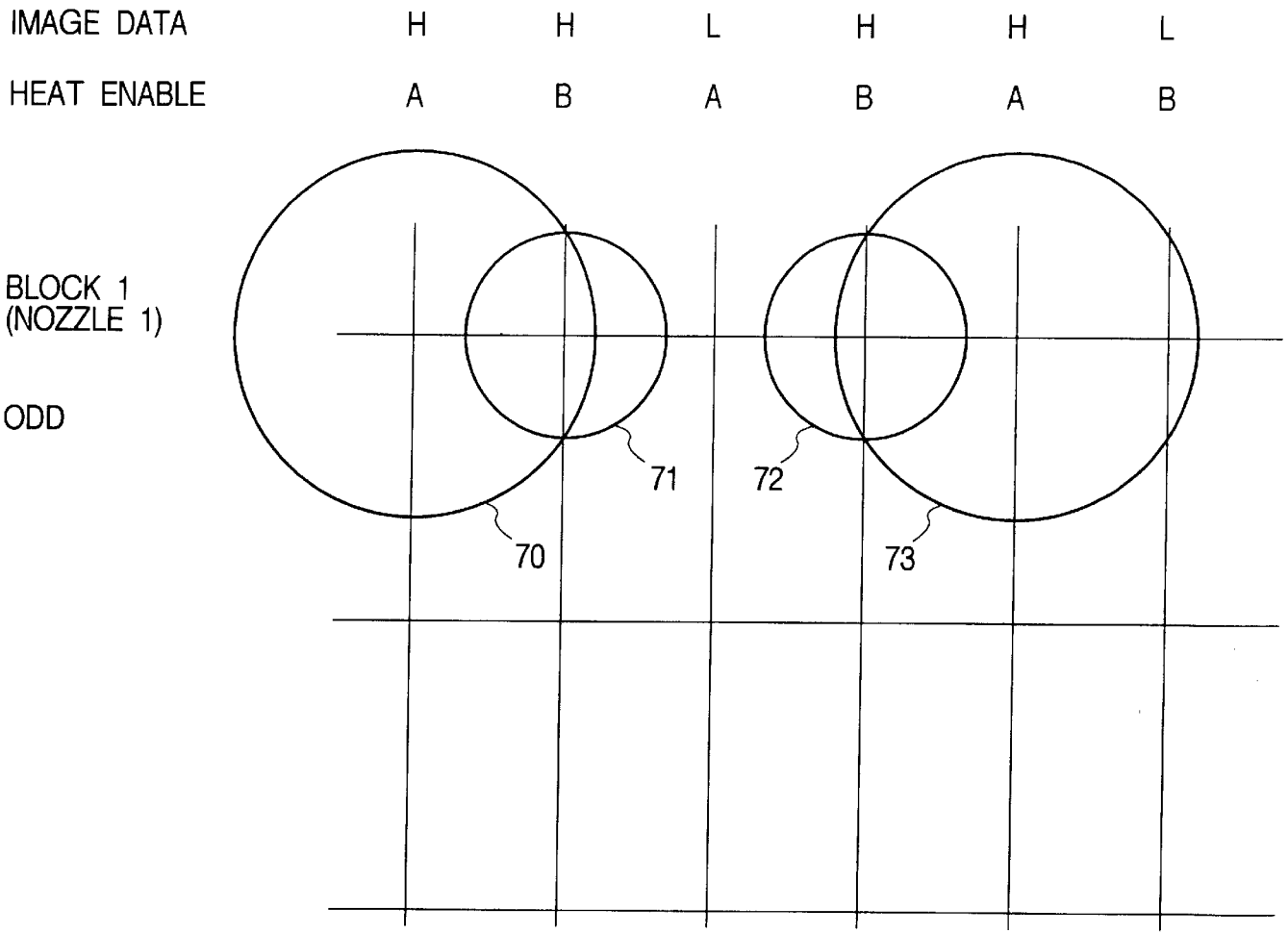
FIG. 7 is a diagram illustrating an example of formation of dots to be recorded by the printer of the embodiment.
Figure 8:
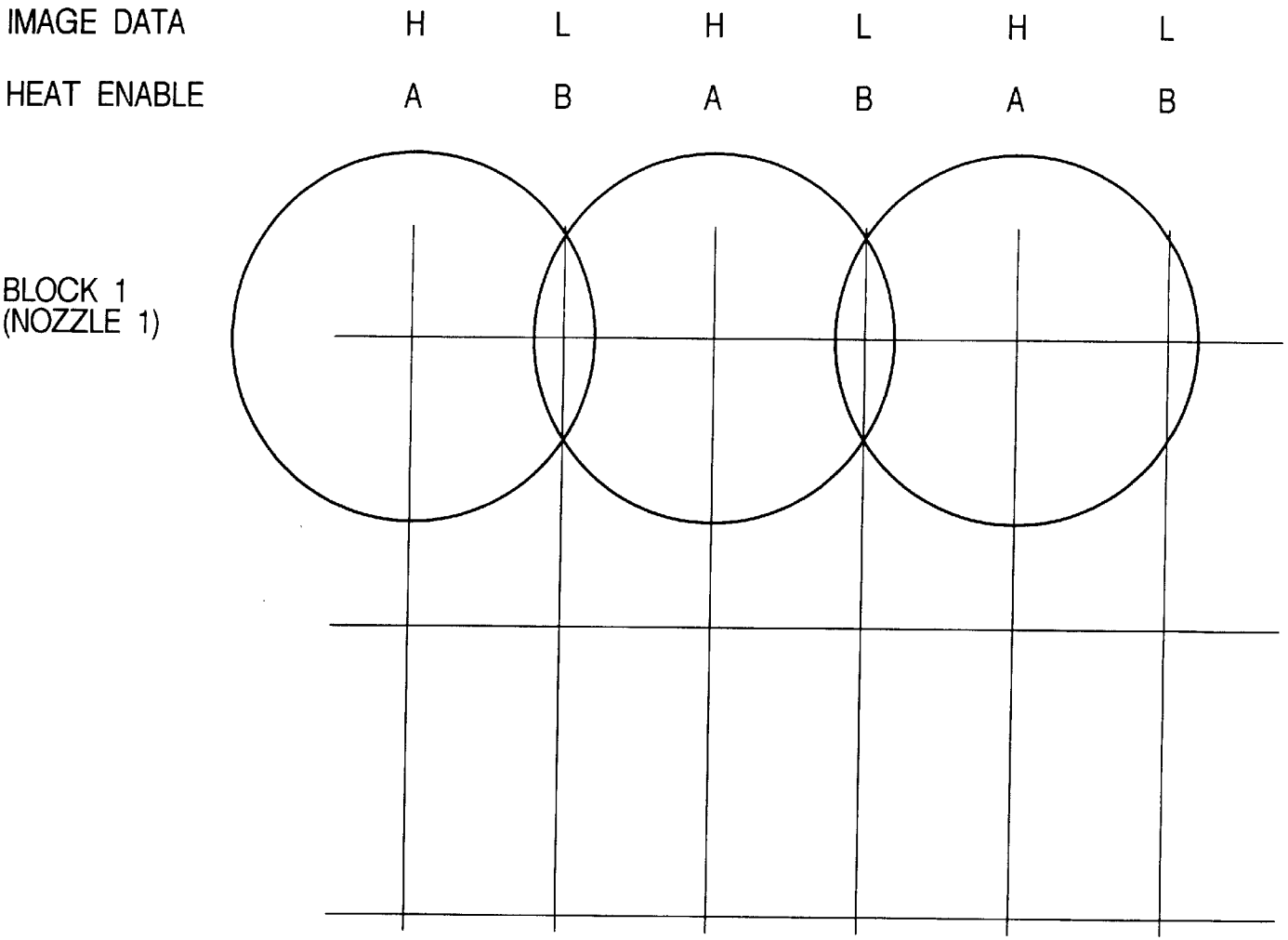
FIG. 8 is a diagram illustrating another example of formation of dots to be recorded by the printer of the embodiment.
Figure 9:
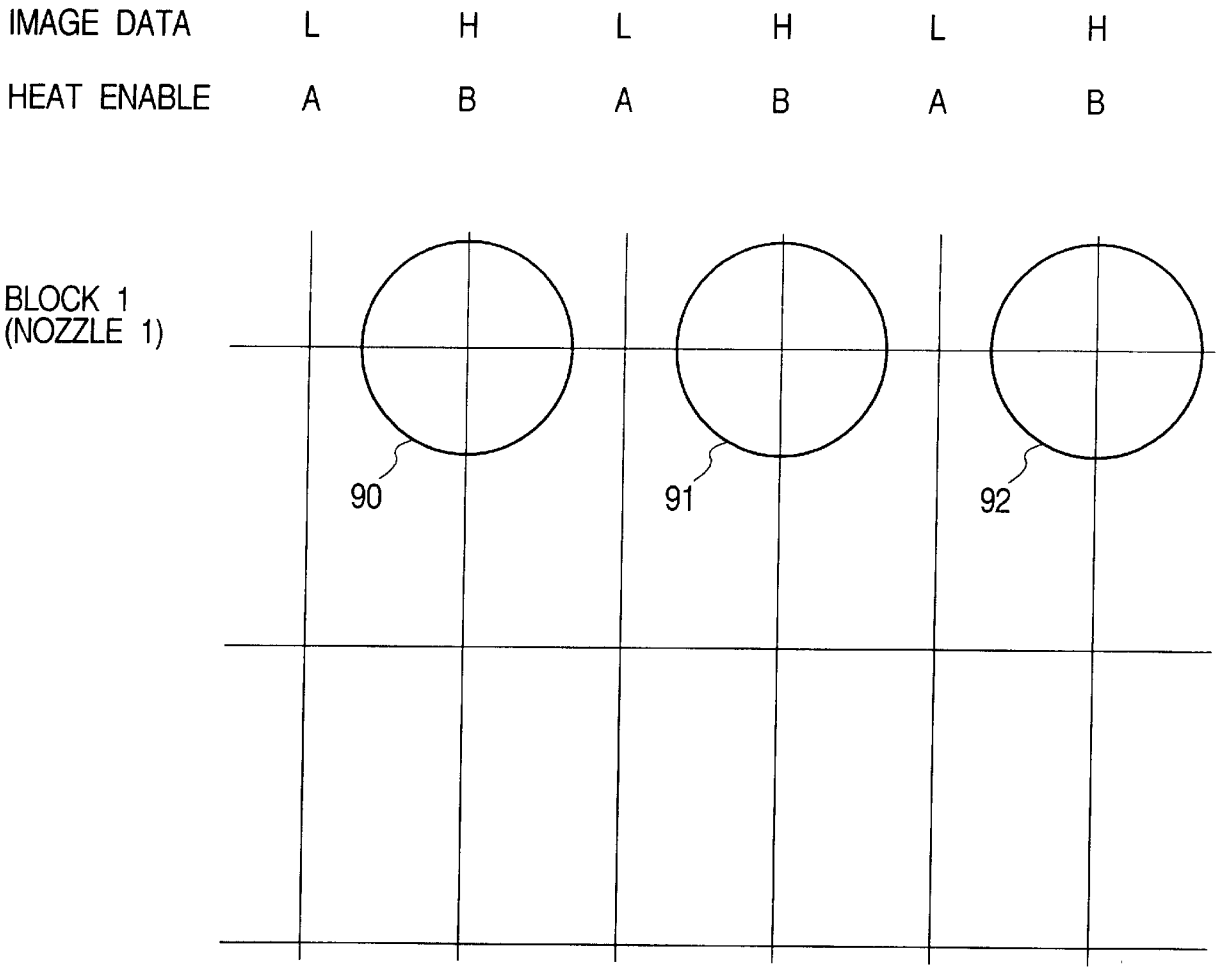
FIG. 9 is a diagram illustrating another example of formation of dots to be recorded by the printer of the embodiment.

Next, a specific example of recording will be described with reference to FIGS. 7 to 9. In order to simplify the description, it is assumed that the recording head has only one nozzle. In FIGS. 7 to 9, a lattice indicated as a grid shows a dot position recorded with the recording head.

In FIG. 7, a distance between grids in the main scan direction is 720 dpi (dot/inch). The nozzle 1 is assumed to belong to the block 1. Since only one nozzle is used in this example, the selection signal 624 for selecting the block 1 and the odd number nozzle selection signal 625 always take an on-level (high level). Image data "H" indicates that there is record data, whereas image data "L" indicates no record data. The heat enable signal A means a transfer of an ejection signal (large dot) to the driver A and the heat enable signal B means a transfer of an ejection signal (small dot) to the driver B.

As shown in FIG. 7, large and small dots are recorded in a mixed state during one record scan. Namely, upon output of the heat enable signal A (corresponding to HEA) and heat enable signal B (corresponding to HEB), large dots 70 and 73 and small dots 71 and 72 are recorded, respectively.

If large dots only are required, the heat enable signal HEA 627 (A) is output when the image data corresponding to the nozzle takes a high level (H), as shown in FIG. 8.

Conversely, if small dots only are required, the heat enable signal HEB 626 (B) is output when the image data corresponding to the nozzle takes a high level (H), as shown in FIG. 9.

Next, recording by a plurality of nozzles of the recording head will be described. As compared to the recording by a single nozzle, a plurality of block selection signals are required when a plurality of nozzles are used. There are several driving methods. In this example, one block is defined as a set of adjacent nozzles identified with odd and even numbers, and the block numbers are set in the ascending order from the block containing the nozzle 1.

Figure 10:
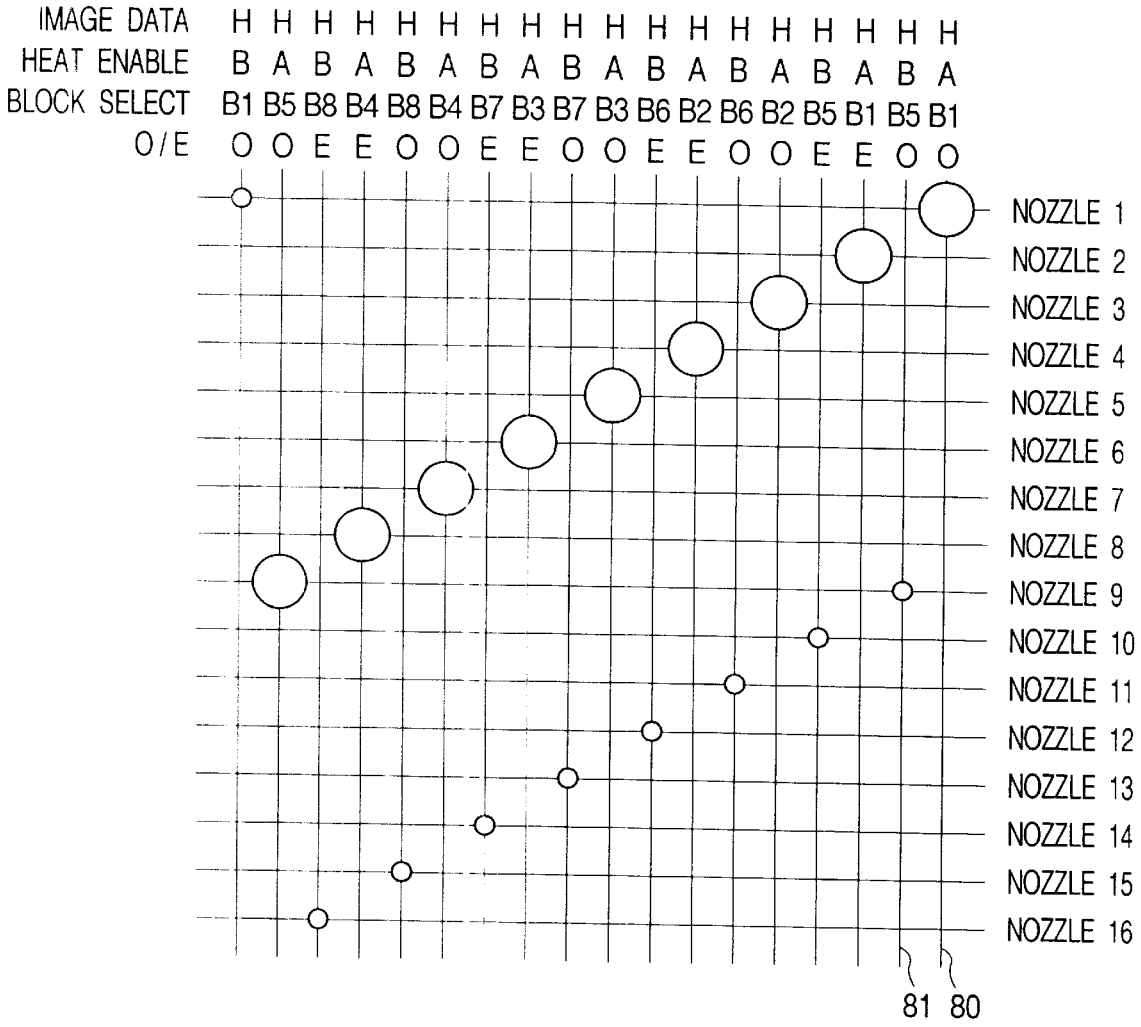
FIG. 10 is a diagram showing drive timings of nozzles of the recording head of the printer according to a 1st Example.

As shown in FIG. 10, the number of blocks of the recording head having 16 nozzles is "8". The block of the nozzle 1 and the adjacent nozzle 2 is a block 1. As the nozzle numbers increases, the block number is sequentially increased as 2, 3, 4, . . . In the example shown in FIG. 10, the nozzles are divided into the block 1 (B1) to block 8 (B8). The nozzle satisfying the conditions of the four signals, including the image data of "H", heat enable signal "ON", block selection signal, and odd/even selection signal, is driven and ink is ejected out of this selected nozzle.

FIRST EXAMPLE

FIG. 10 shows an example of timings when inks are ejected out of all the nozzles 1 to 16 during one period and dots are recorded.

At a timing 80 for the nozzle 1, if the four signals satisfy the conditions that the image data "H", heat enable signal "A", block selection signal (block 1: B1) and odd/even selection signal (odd: 0), then because of the heat enable signal "A", a drive signal is supplied to the driver A connected to the ejection heater A of the nozzle 1 to form a large dot. At the next timing 81 for the nozzle 9 of the block 5 (head is mounted obliquely), if the four signals satisfy the conditions that the image data "H", heat enable signal "B", block selection signal (B5) and odd/even selection signal (odd: 0), then because of the heat enable signal "B", a drive signal is supplied to the driver B connected to the ejection heater B of the nozzle 9 to form a small dot.

Next, the nozzle 2 of the block 1 and the nozzle 10 of the block 5 are processed in a similar manner, and after the nozzle 16 of the block 8 is driven, large dots for one scan period are recorded for the nozzles 1 to 8 and small dots for one scan period are recorded for the nozzles 9 to 16. As small dots for the nozzles 1 to 8 and large dots for the nozzles 9 to 16 respectively for one scan period are recorded thereafter (in FIG. 10, this state is partially shown), recording of two scan periods are therefore completed, including large dots for one period and small dots for one period with respect to all the nozzles 1 to 16.

Figure 11:
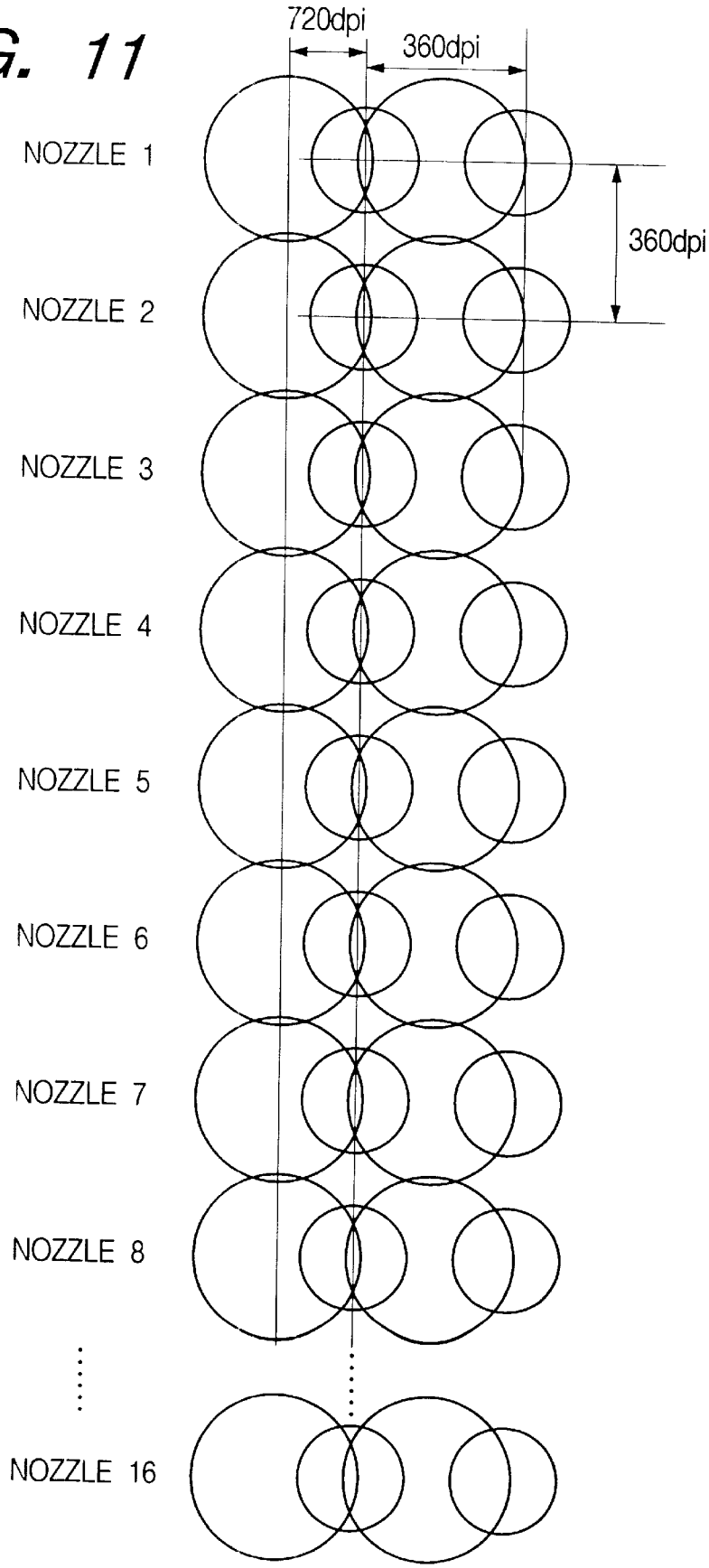
FIG. 11 is a diagram showing dot positions recorded by the printer of the embodiment at the timings shown in FIG. 10.

An image recorded in the above manner is shown in FIG. 11. FIG. 11 shows dot positions on recording medium when the ejection timings of respective nozzles are synchronized with respective addresses corresponding to a resolution of 720 dpi×360 dpi. In FIG. 11, a maximum density of record data of 2-bit of each of the nozzles corresponds to "11", and each nozzle records two pixels, totaling two scan periods (32 dots) of large dots and two scan periods (32 dots) of small dots.

An example of the printer capable of recording large and small dots in the above manner, applied to a practical printer system, will be described.

Figure 12:
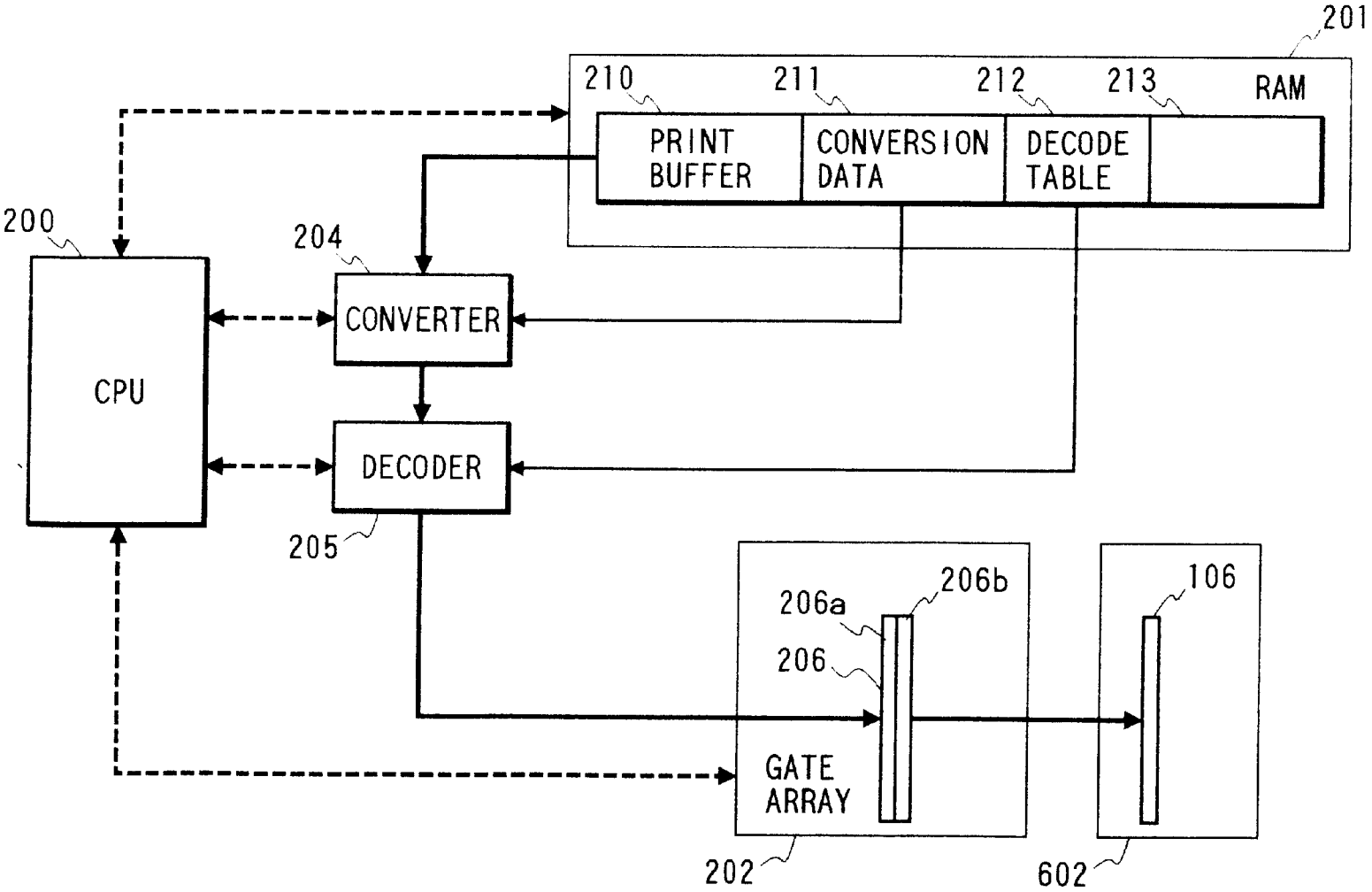
FIG. 12 is a block diagram showing the structure of a record data processing circuit of the printer of the embodiment.

FIG. 12 is a diagram showing a flow of data transferred from a printer control unit to the head 106. Like parts to those shown in the already described drawings are represented by identical reference numerals and the description thereof is omitted.

Reference numeral 200 represents a CPU which controls the overall operation of the printer of this embodiment. In FIG. 12, only a signal flow characteristic to this embodiment is shown. Reference numeral 201 represents a RAM (random access memory) which has a print buffer 210 for storing print data, a conversion data area 211 for storing conversion data used for pixel data conversion, a decode table 212, a working area 213, and the like. The print data stored in the print buffer 210 is pixel data constituted of two bits. A gate array 202 reads the print data stored in the print buffer 210 by direct memory access (DMA). Generally, data of a multiple of a word (16 bits) is read from the print buffer 210. Therefore, as shown in the data structure of FIG. 13, the gate array 202 reads the data of 2-bit surrounded by a bold line. Reference numeral 204 represents a data converter for converting pixel data in accordance with the conversion data to perform division of data of each path for multi-path recording and perform other operations. Reference numeral 205 represents a decoder for decoding (modulating) 2-bit print data by referring to a data table (modulating data table) stored in the decode table 212. Reference numeral 206 represents a register for the gate array 202, the register 206 including a register 206*a* for storing large dot forming data and a register 206*b* for storing small dot forming data.

Figure 13:
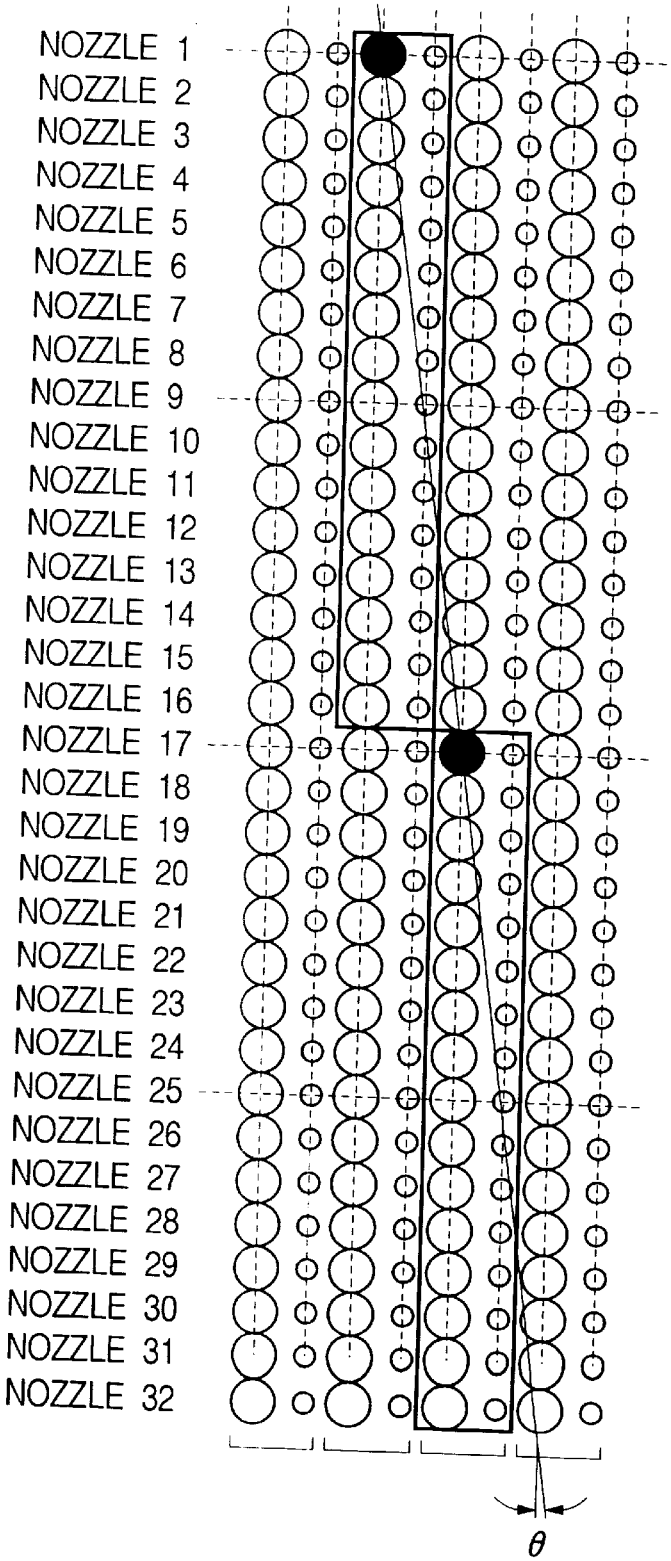
FIG. 13 is a diagram illustrating nozzle drive timings when recording head of the embodiment is driven.

FIG. 13 is a diagram illustrating ink ejection timings of respective nozzles of the recording head. A large diameter circle indicates a large dot ejection timing, and a small diameter circle indicates a small dot ejection timing. In the example shown in FIG. 13, a portion (only 32 nozzles) of a recording head having 256 nozzles is shown. This head is mounted obliquely at a predetermined angle θ relative to the direction perpendicular to the head scan direction (horizontal left direction in FIG. 13).

Referring to FIG. 13, two nozzles are driven at the same time to eject inks in such a manner that during the first period, large dots of the nozzles 1 and 17, small dots of the nozzles 9 and 25, large dots of the nozzles 2 and 18, small dots of the nozzles 10 and 26, . . . , large dots of the nozzles 8 and 24, and small dots of the nozzles 16 and 32 are recorded in this sequential order. Prior to the second period, 2-bit data adjacednt to the left side of the data surrounded by the bold line is read, and during the second period, two nozzles are driven at the same time to eject inks in such a manner that small dots of the nozzles 1 and 17, large dots of the nozzles 9 and 25, small dots of the nozzles 2 and 18, . . . are recorded. The above processes are performed for all the 32 nozzles to record 32 pixels in total having the maximum density (large dot and small dot). During the next third period, similar to the first period, two nozzles are driven at the same time in such a manner that large dots of the nozzles 1 and 17, small dots of the nozzles 9 and 25, large dots of the nozzles 2 and 18, . . . are recorded. In the example of FIG. 13, all of the 2-bit data recorded by nozzles are shown at a maximum density "11". For each pixel, a small dot is first recorded and then a large dot is recorded.

In this embodiment, in order to express gradation of 2-bit print data by using a combination of two dots, the print data is read from the print buffer 210 and stored in the register 206 of the gate array 202. In this case, before the data is stored, it is converted by the data converter 204 and decoder 205. This data conversion may be performed in various ways for both one path recording and multi-path recording. First, an example of the data conversion for the one path recording will be described.

Figures 14, 15:
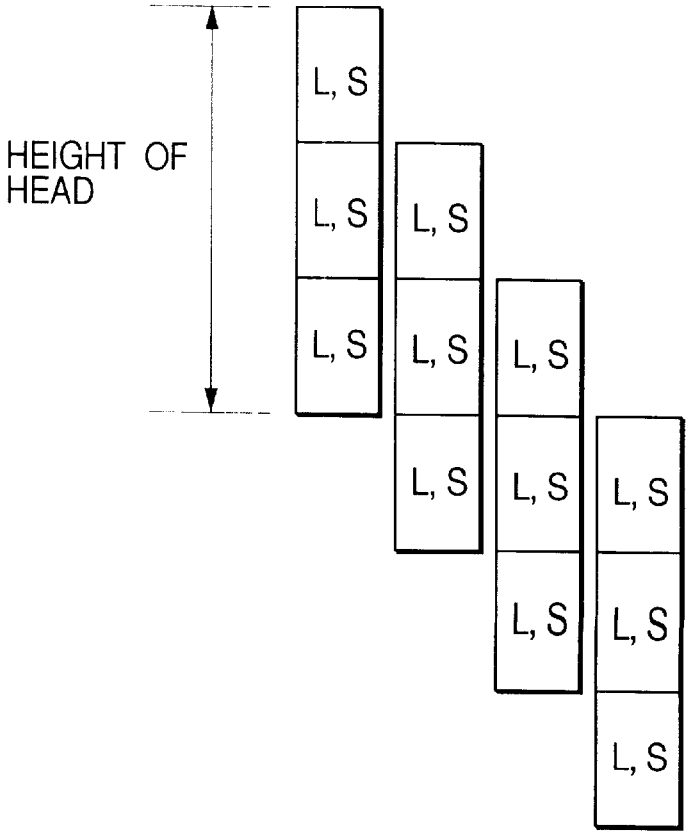
FIG. 14 is a diagram showing examples of decode outputs of 2-bit record data.
FIG. 15 is a diagram illustrating a multi-path recording method.

FIG. 14 shows an example of print data of each pixel read from the print buffer 210 and represented by two bits by using the decoder 205.

In the printer of this embodiment, four-valued data (each pixel being represented by two bits) output from the printer driver 103 of the host computer is written in the print buffer 210. Next, the 2-bit print data stored in the print buffer 210 is decoded by the two-bit decoder 205 in accordance with correspondence shown in FIG. 14 and the contents stored in the decode table 212 and DMA-transferred to the register 206 of the gate array 202. In this case, during one path recording, the print data passes through the data converter 204 without being converted by it. In the example shown in FIG. 14, the upper bit of two bits is assigned the large dot and the lower bit thereof is assigned the small dot. Instead, by changing the contents of the decode table 212, the decoder 205 may output desired decode outputs for the two-bit print data. A pixel represented by a multi-value is formed by a plurality of dots, these dots being called sub-pixels. In the example shown in FIG. 13, a sub-pixel is formed by first recording a small dot and then recording a large dot.

Next, multi-path recording will be described. As shown in FIG. 15, recording medium is fed in the sub scan direction by 1/n-th (in the example shown in FIG. 15, n=3) the length of the nozzle train (height of head) each time one record scan is performed, and complementary data is printed to form an image.

In FIG. 15, recording medium is fed by a distance corresponding to one-third the length of the nozzle train each time one record scan is performed to conduct recording by three paths (corresponding to one band). According to the conventional recording method, after a thinned image is printed during one record scan in the main scan direction, the recording medium is fed in the sub-scan direction to perform the next recording in the main scan direction to record an additional image on a thinned portion formed during the preceding recording. In this embodiment, two-bit print data is output in a similar manner described above for each main scan record. Therefore, in addition to the conventional thinning function (in this case, data conversion), a decode function is used to further broaden the gradation representation.

This function will be described with reference to FIG. 16.

Figure 17:
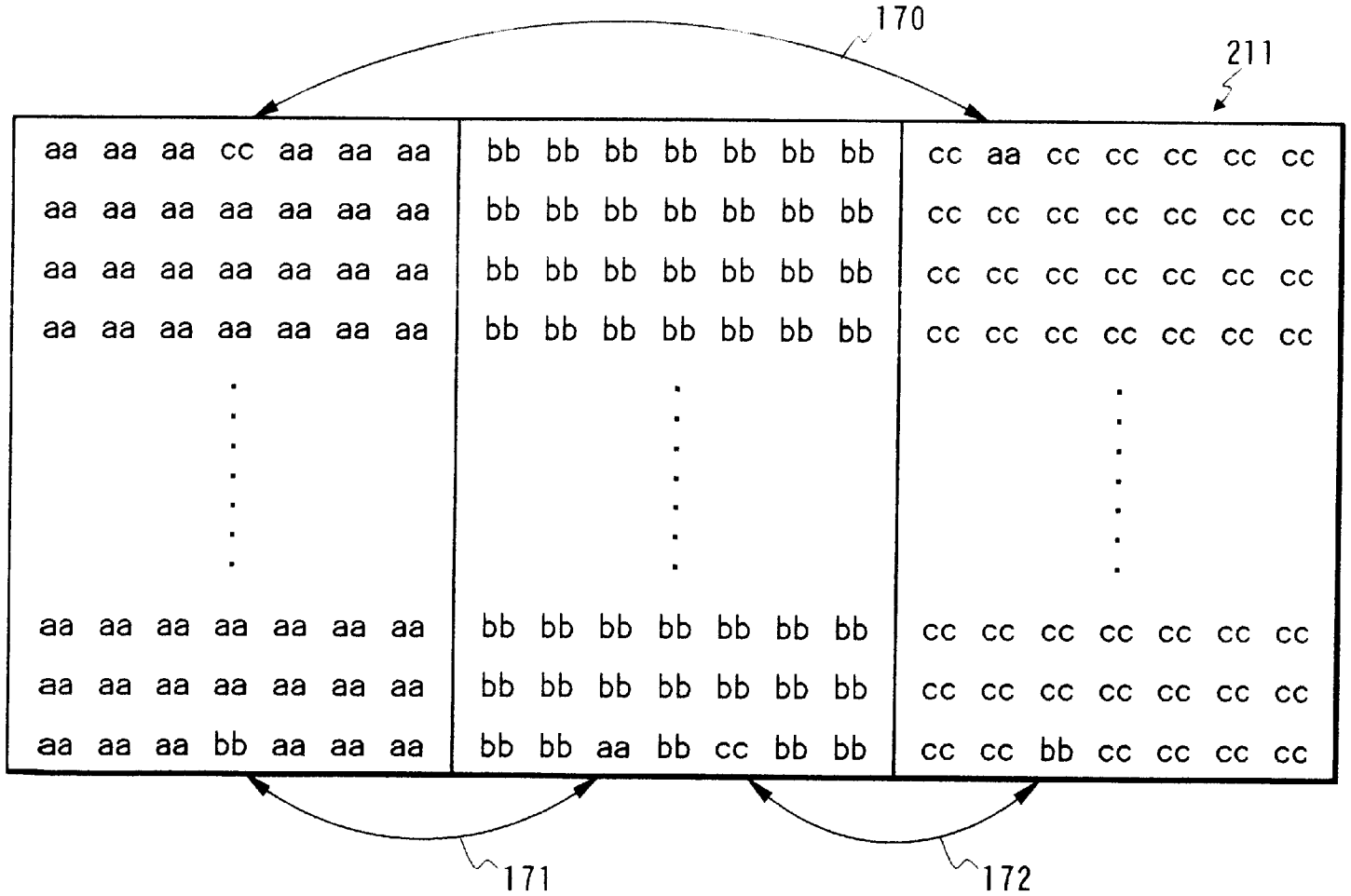
FIG. 17 is a diagram illustrating a random mask of the embodiment.

In this embodiment, two bits of print data shows one tonal level, and so a combination of two bits is used for generating thinning data (for data conversion) and stored in the conversion data area 211 of RAM 201. In generating such data, three two-bit data sets in the case of three-path recording, including "aa" for first recording path, "bb" for second recording path, and "cc" for third recording path, all having the same number of data elements, are stored in the memory area 211, as shown in FIG. 17.

Next, three two-bit data sets are interchanged and shuffled. This operation is repeated more than predetermined times to generate random number tables with interchanged three data sets as indicated at 170, 171 and 172 in FIG. 17. The data generated in this manner is stored in the conversion data area 211 shown in FIG. 12. In the three-path recording, data for each record scan is converted into print data by the data conversion circuit 204 in accordance with the conversion data. This example is shown in FIG. 16.

Figure 16:
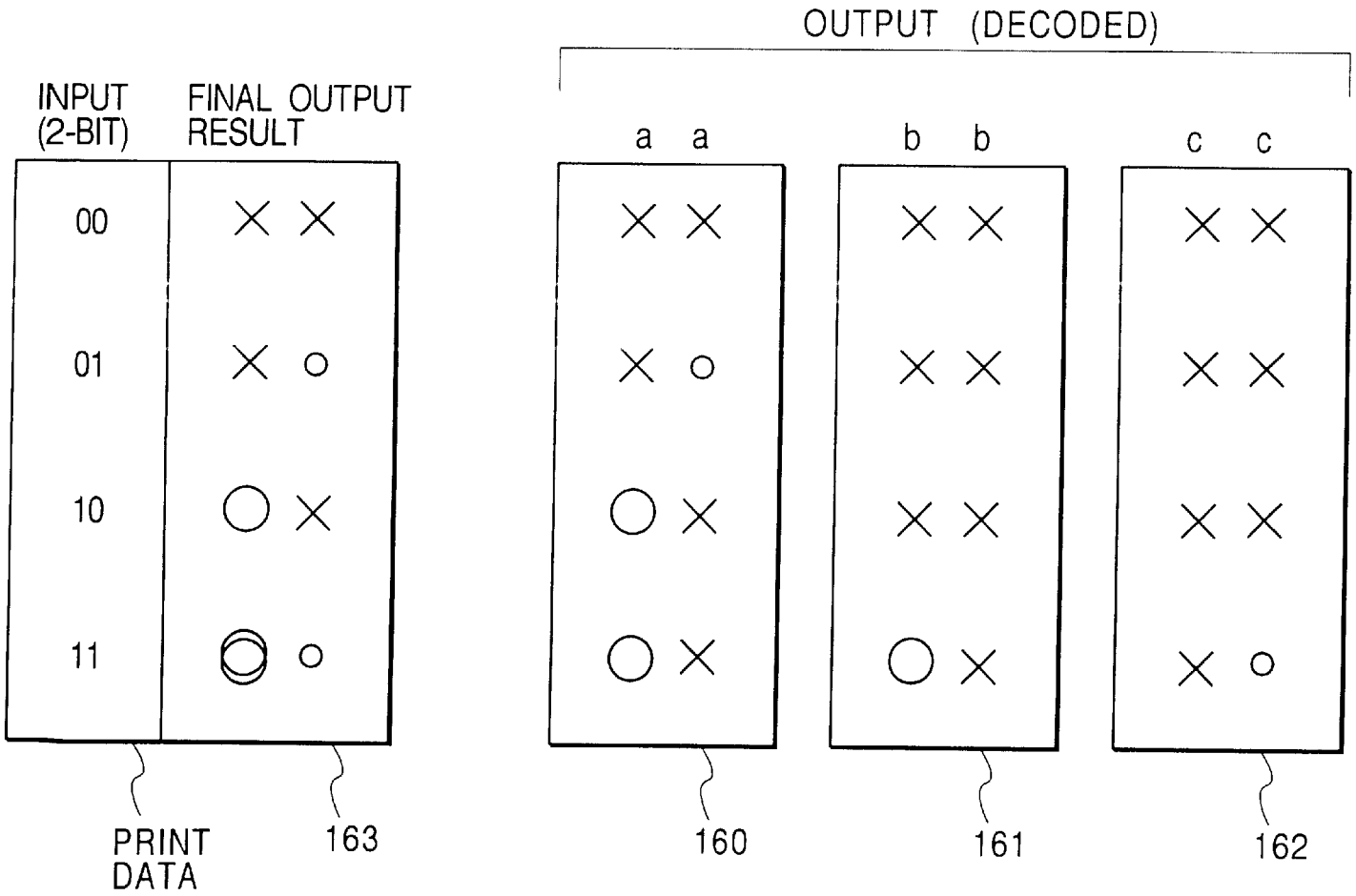
FIG. 16 is a diagram showing an example of decode outputs of two record data of the embodiment.

In the examples shown in FIG. 16, an example indicated at 160 shows two-bit print data converted by data "aa" and further converted by the decoder 205 in accordance with the contents of the decode table 212. An example indicated at 161 shows print data converted by data "bb" and further converted by the decoder 205 in accordance with the contents of the decode table 212. An example indicated at 162 shows print data converted by data "cc" and further converted by the decoder 205 in accordance with the contents of the decode table 212. An example indicated at 163 shows the print results of each pixel printed by three record scans.

In the examples shown in FIG. 16, the print data "00" indicates "xx" representative of no record dot, the print data "01" indicates a lowest density with only one small dot recorded during three record scans, the print data "10" indicates only one large dot recorded, and the print data "11" indicates two large dots double-printed and one small dot. FIG. 16 shows particular examples only and the invention is not limited only to these examples.

By changing the contents of the decode table 212 in RAM 101, it is possible to select one of a plurality of combinations, for example, one of the four final output results shown in FIG. 16.

In addition to the above combinations, a mixed combination of large and small dots may be used in such a manner that all tables are set so that large dots are recorded, or that a pixel with three large dots and three small dots provides a largest density. Such combinations may be set by properly selecting a maximum ink injection amount relative to recording medium, a change ratio of luminance at an intermediate density for each combination of large and small dots, and the like.

With the bit arrangement described above, each two-bit data is uniformly distributed for each scan in a random manner. It is therefore possible to reduce almost a difference between the numbers of recorded dots during respective record scans.

Further in this embodiment, use of the two-bit decode table allows the arrangement of large and small dots to be tangled and shuffled into combinations of two-bit data sets. Therefore, even if the numbers of large and small dots are very different, it is possible to uniformly distribute them in each record scan. As compared to a conventional dynamic range of a maximum of two dots and the number of tonal levels of three in the case of two-bit print data, use of the embodiment function allows printing by a combination of three large dots and three small dots at a maximum in combination with a recording head capable of printing large and small dots, multi-path recording, decoded by two-bit code, random conversion data, and the like. In addition, four tonal levels among 16 levels can be selected as desired. Still further, the gradation representation capability and dynamic range can be improved considerably by increasing the number of paths of multi-path recording and using such as 3-, 4-bit codes in place of the 2-bit code. The number of modulating levels is not limited to only two levels including large and small dots, but it may be increased further.

Figure 18:
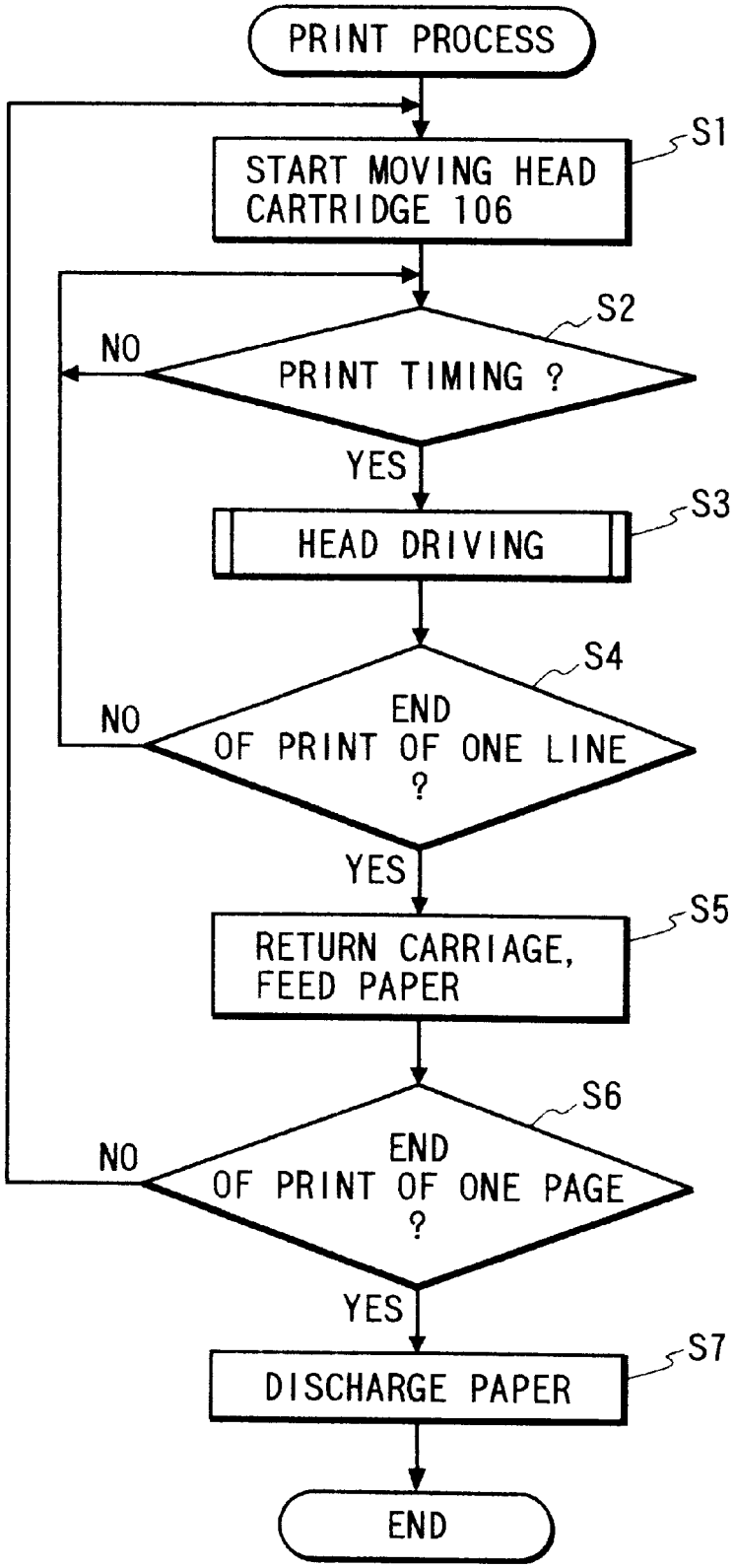
FIG. 18 is a flow chart illustrating a print operation by the ink jet recording apparatus of the embodiment.

FIG. 18 is a flow chart illustrating a print process to be executed the ink jet printer of the embodiment. This print process is executed under the control of CPU 200. This process starts when data supplied from the host computer is stored in the print buffer 210 by the amount of at least one scan data or one page data.

First, at Step S1 the carriage motor 6 starts rotating and the head cartridge 106 starts moving. At Step S2 it is checked whether it is a print timing of the recording head. If so, the flow advances to Step S3 to drive the head and record dots with one train of nozzles of the head (detailed in the flow chart of FIG. 19). At Step S4 it is checked whether one line print has been completed. If not, the flow returns to Step S2, whereas if completed, the flow advances to Step S5 whereat the carriage is returned and the recording medium is fed by a distance corresponding to a record width. At Step S6 it is checked whether the one page print has been completed. If not, the flow returns to Step S1, whereas if completed, the flow advances to Step S7 to eject the printed recording medium.

With reference to the flow chart shown in FIG. 19, a head drive process to be executed by the ink jet printer of the embodiment will be described.

First at Step S11, print data for one nozzle train of the head is read from the print buffer 210. At Step S12, the data is passed through the data converter 204 without being processed by it, decoded by the decoder 205, and set in the registers 206*a* and 206*b* of the gate array 202 through DMA. At Step S13 the data set in the registers 206*a* and 206*b* is transferred to the shift register 602. In this embodiment, the heaters A and B of each nozzle are driven at different timings in accordance with the record data to form one pixel of a certain tonal level (constituted of two dots at a maximum) corresponding to that of the record data. Therefore, it is first checked at Step S14 whether it is a drive timing of the heater A. If so, the flow advances to Step S15 whereat the block selection signal 624 and odd/even signal 625 are output to determine the position of the nozzle to be driven and thereafter the signal 627 for driving the heater A is output. In this manner, if the data for the selected nozzle is "1", a large dot is printed.

At the next Step S16, it is checked whether it is a drive timing of the heater B. If so, the flow advances to Step S17 whereat the block select signal 624 and odd/even signal 625 are output to determine the position of the nozzle which drive the heater B and thereafter the heat signal 626 is output. In this manner, if the data for the selected nozzle is "1", a small dot is printed by the selected nozzle.

The flow then advances to Step S18 whereat it is checked whether all the nozzles of the head have been driven and the printing by them has been completed. If so, the flow returns to the original routine, whereas if not, the flow returns to Step S14 to check the timings of the heaters A and B of the next nozzle. In this manner, printing by the other nozzles is sequentially executed.

Figure 19:
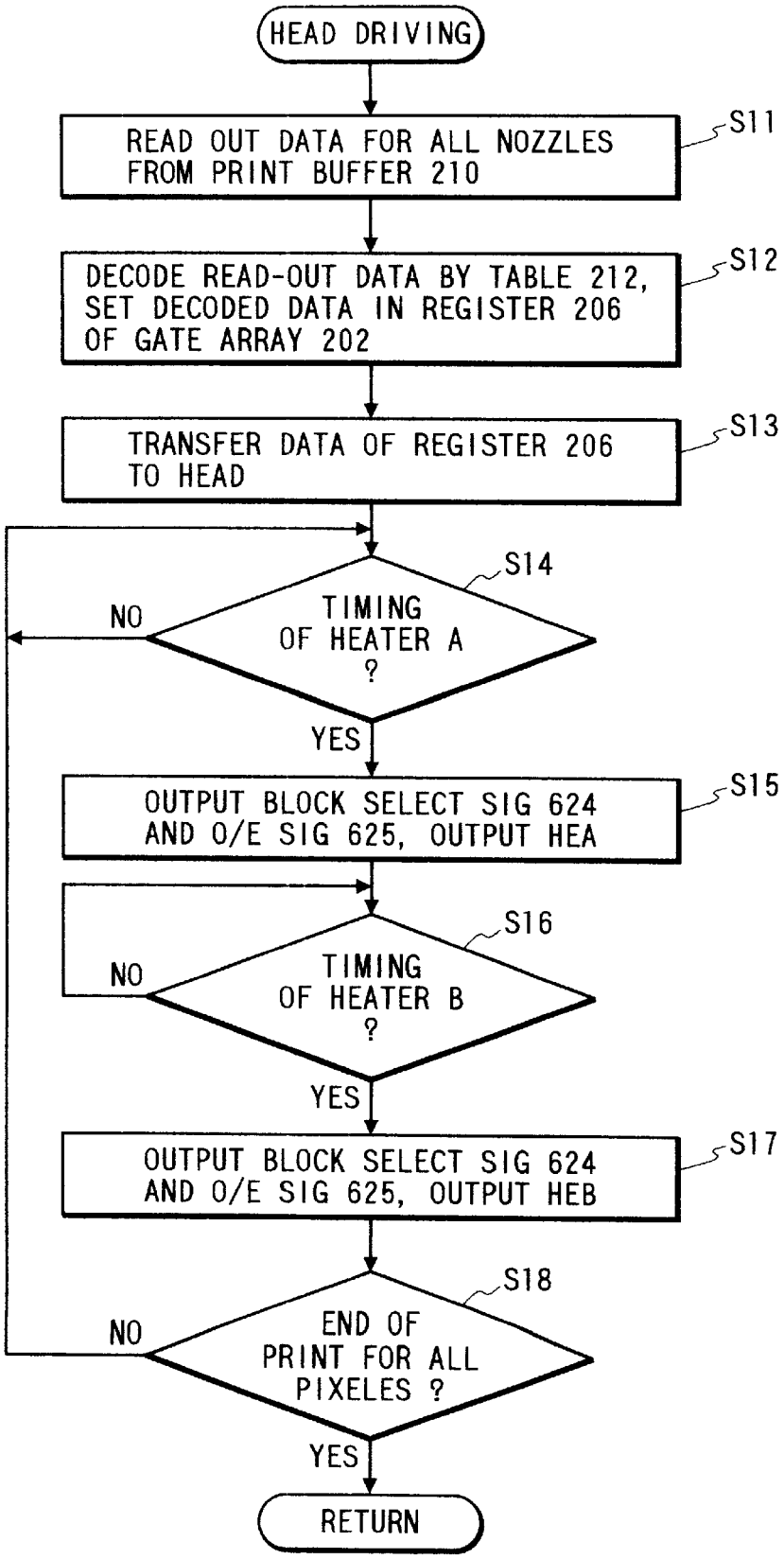
FIG. 19 is a flow chart illustrating a head drive process at Step S3 shown in FIG. 18.
Figure 20:
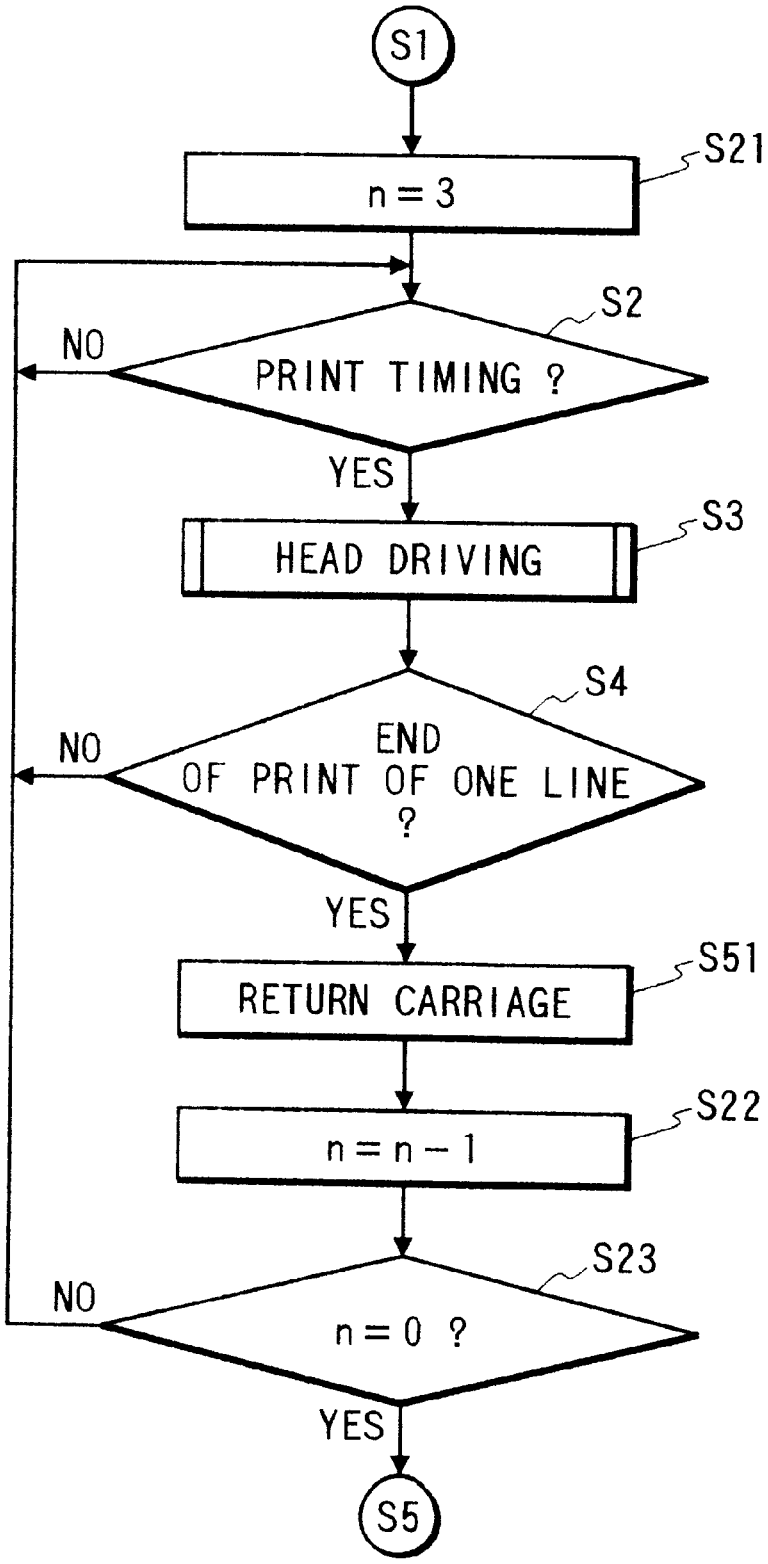
FIG. 20 is a flow chart illustrating three-path recording of the embodiment.

FIG. 20 is a flow chart illustrating a print process during three-path recording of the embodiment. Similar processes to those shown in the flow chart of FIG. 19 are represented by identical process numbers and the description thereof is omitted.

At Step S21 the number n is set to "3". After one record scan, at Step S22 a calculation of n=n−1 is carried out, and the head is driven by repeating Steps S2 to S22 until it becomes n=0 at Step S23. In this case, the record data for each record scan is generated by the data converter 204 and decoder 205 shown in FIG. 12.

SECOND EXAMPLE

In the first example, a plurality of dots including large and small dots are used in accordance with the gradation of pixel data for recording pixel data represented by two bits. In the first example, the importance of the record order of large and small dots is not specifically described. However, it is known that the positions of small and large dots ejected from nozzles and recorded on recording medium shift slightly. Therefore, the record positions of small and large dots during one record scan of the recording head displace although this displacement is minute, so that a texture or the like may be formed on the recorded image.

Figure 26A:
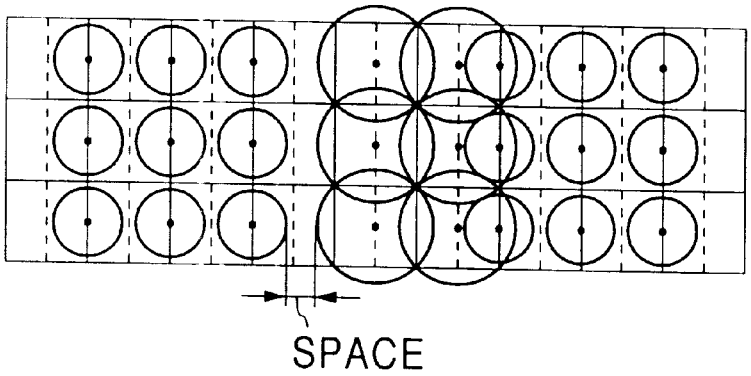
FIGS. 26A, 26B and 26C are diagrams illustrating the generation of texture caused by a speed difference of ejected inks of large and small dots.
Figure 26B:
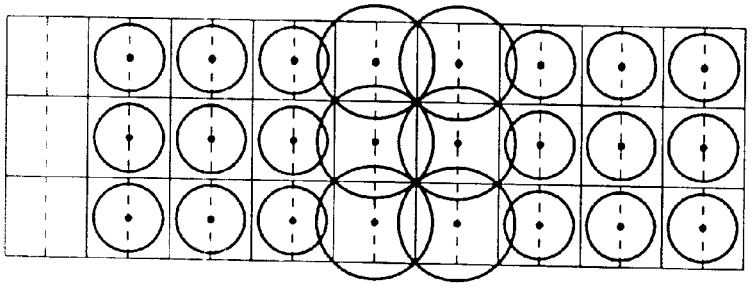
Figure 26C:
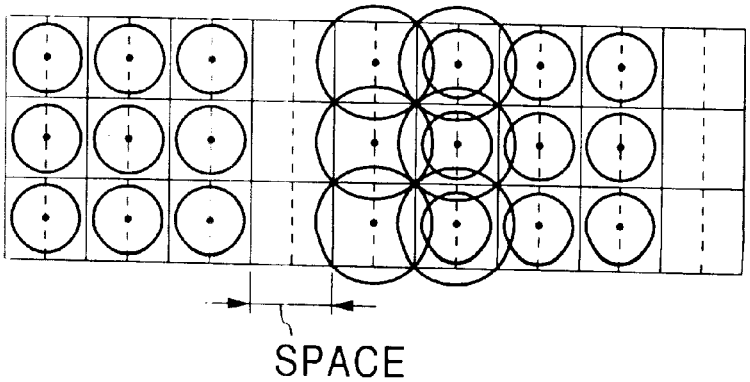

FIGS. 26A to 26C show examples of recorded dots while the recording head is moved from the right to left as viewed in FIGS. 26A to 26C, and illustrate a displacement of recorded small and large dots caused by an ejection speed difference.

In FIG. 26A, timings indicated by solid lines represent true record positions of large dots, and timings indicated by broken lines represent true record positions of small dots. In this state, dots are formed at the same timings as the ejection timings (a distance between centers of adjacent dots (pixel length)=0). In FIG. 26B, a small dot is recorded at an advanced position from the true position by 0.5 pixel length. In this case, although a space is formed between pixels as shown in FIG. 26A, this space is filled, and the overlapped area of the large and small dots disappears. In FIG. 26C, a small dot is recorded at a delayed position from the true position by 0.5 pixel length. In this case, the small and large dots forming a pixel are completely superposed one upon the other, and a space between pixels is clearly shown. Namely, it is desired that a plurality of dots forming one pixel (sub pixel) are positioned near each other. In the Second Example, the record timings of large and small dots are definitely determined to prevent above disadvantages.

A carriage speed $V_c$ for moving the recording head is given by:

$$V_c\ (mm/s)=\{25.4\ (mm)/N\}\times f$$

where f (Hz) is the highest drive frequency used when a dot of the same size is recorded by the same nozzle of the recording head, and N (dpi) is a record resolution.

If a distance between the tip of the nozzle of the recording head and the recording sheet (recording medium) is represented by L, a speed of a large ink droplet (for large dot) ejected from the nozzle is represented by V1 (mm/s), and a speed of a small ink droplet (for small dot) ejected from the nozzle is represented by V2 (mm/s), then a position displacement d1 of the recording head in the scan direction during the time period required for a large ink droplet ejected from the nozzle to reach a recording sheet is given by:

$$d1\ (mm)=V_c\times L/V1$$

Similarly, a position displacement d2 of the recording head in the scan direction in the case of a small ink droplet is given by:

$$d2\ (mm)=V_c\times L/V2$$

Therefore, a position displacement when the large and small ink droplets are ejected at the same time is given by:

$$d2-d1=V_c\times L\ (1/V2-1/V1)$$

$$=(25.4/N)\times f\times L\ (1/V2-1/V1)\ (mm)$$

Since a unit length of one pixel is 25.4/N, the displacement (d2−d1) represented by the pixel length is given by:

$$(d2-d1)/(25.4/N)=f\times L\ (1/V2-1/V1)$$

$$=f\times L\ (V1-V2)/(V1\times V2)$$

(in the unit of pixel)

It has been confirmed already that if the displacement of centers of two large and small dots is 0.5 pixel or smaller, the quality of a recorded image is not adversely affected even if large and small dots are recorded alternately. By substituting this relationship into the above equation, the following formula is obtained:

$$-0.5\ (\text{pixel})\leqq f\times L\ (V1-V2)/(V1\times V2)-0.5\leqq 0.5$$

i.e., $$0\leqq f\times L\ (V1-V2)/(V1\times V2)\leqq 1.0$$

If this formula is satisfied, it is possible to prevent the image quality from being degraded.

Figure 21A:
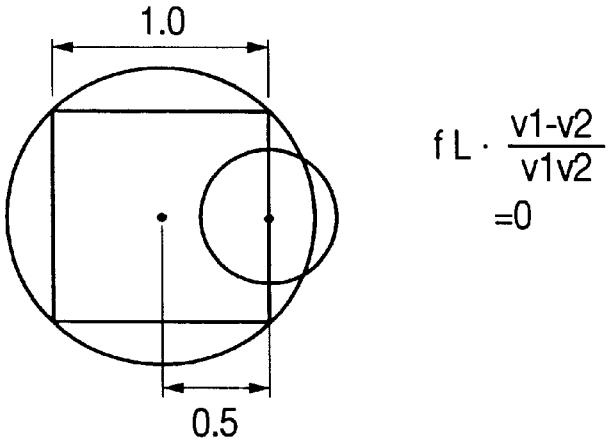
FIGS. 21A, 21B and 21C are diagrams illustrating how disadvantages can be eliminated which are associated with the case wherein a large dot is first recorded and a small dot is next recorded for recording a pixel by a plurality of dots.
Figure 21B:
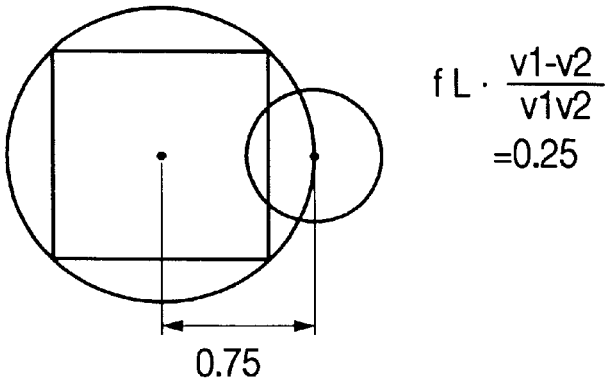
Figure 21C:
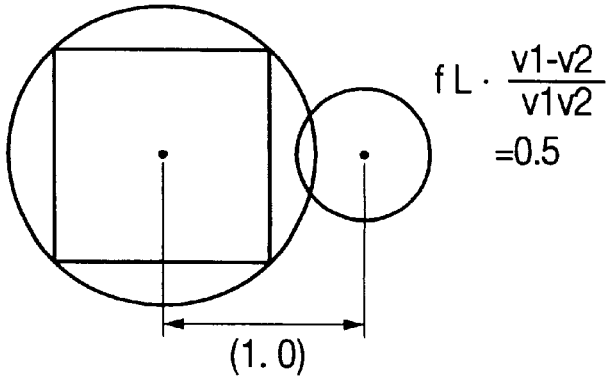

FIGS. 21A to 21C are diagrams showing the position relationship between large and small dots recorded in this order upon ejection of inks at an equal time interval (corresponding to 0.5 pixel). FIG. 21A shows the relationship between dot positions in which the large dot is first recorded and then the small dot is recorded at the same ejection speed or at the distance L of "0" (practically impossible) between the nozzle tip and recording sheet. In this case, the distance between centers of the large and small dots is 0.5 pixel. FIG. 21B shows a position displacement by 0.25 pixel caused by an ejection speed difference between large and small ink droplets, the distance L between the nozzle tip and recording sheet and the like. In this case, the distance between centers of the large dot and small dot recorded after the large dot is 0.75 pixel. FIG. 21C shows a position displacement by 0.5 pixel caused by an ejection speed difference between large and small ink droplets, the distance L between the nozzle tip and recording sheet and the like. In this case, the distance between centers of the large dot and small dot recorded after the large dot is 1 pixel.

FIGS. 22A to 22E show examples in which such a record position displacement of large and small dots to be caused by an ejection speed difference between large and small ink droplets, the distance L between the nozzle tip and recording sheet and the like, is eliminated by first recording a small dot and then recording the large dot.

Figure 22A:
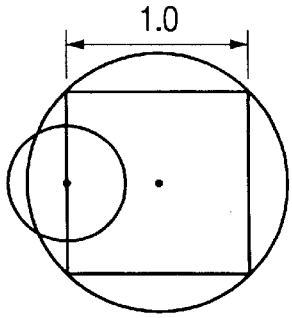
FIGS. 22A, 22B, 22C, 22D and 22C show examples of dot position displacement when a small dot is recorded first and then a large dot is recorded, according to a second Example.
Figure 22B:
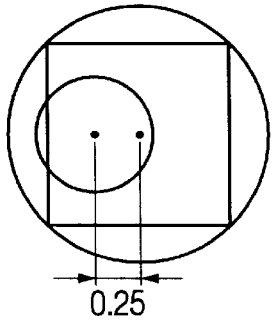
Figure 22C:
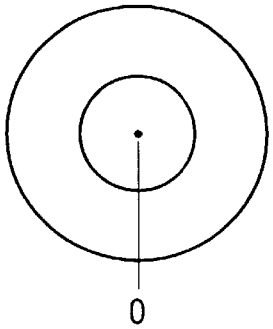
Figure 22D:
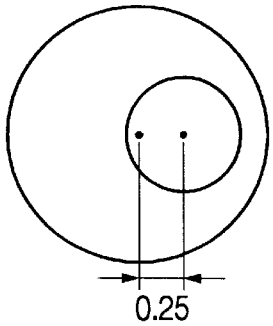
Figure 22E:
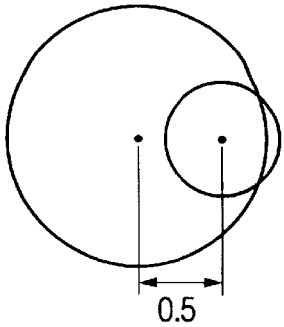

FIG. 22A shows a dot position relationship in which the large dot is first recorded and then the small dot is recorded at the same ejection speed or at the distance L of "0" (practically impossible) between the nozzle tip and recording sheet. In this case, the distance between centers of the large and small dots is 0.5 pixel. FIG. 22B shows a position displacement by 0.25 pixel caused by an ejection speed difference between large and small ink droplets, the distance L between the nozzle tip and recording sheet and the like. In this case, the distance between centers of the small dot and large dot recorded after the small dot is 0.25 pixel, and the small dot is included in the large dot. FIG. 22C shows a position displacement by 0.5 pixel caused by an ejection speed difference between large and small ink droplets, the distance L between the nozzle tip and recording sheet and the like. In this case, the center of the small dot and the center of the large dot recorded after the small dot are generally at the same position. FIG. 22D shows a position displacement by 0.75 pixel. In this case, the center of the small dot is spaced apart from the center of the large dot recorded after the small dot, by 0.25 pixel. FIG. 22E shows a position displacement by 1.0 pixel. In this case, the center of the small dot is spaced apart from the center of the large dot recorded after the small dot, by 0.5 pixel.

As above, in recording one pixel by using a plurality of large and small dots, if the large dot for the pixel is first recorded and then the small dot for the pixel is recorded, the distance between large and small dots becomes long as shown in FIGS. 21A to 21C. Therefore, the image quality becomes granular and is degraded, or stripe patterns, texture patterns or the like are formed in the recorded image. In contrast, in this Second Example, the small dot for one pixel is first recorded and then the large dot for the pixel is recorded, so that the two dots are generally superposed one upon the other as shown in FIGS. 22A to 22E to thereby allow a high quality image to be recorded while the pixel gradation is retained.

FIG. 23, FIGS. 24A to 24C and FIGS. 25A and 25B show examples of arrangements of heaters of an ink jet head used by the First and Second Examples.

Figure 23:
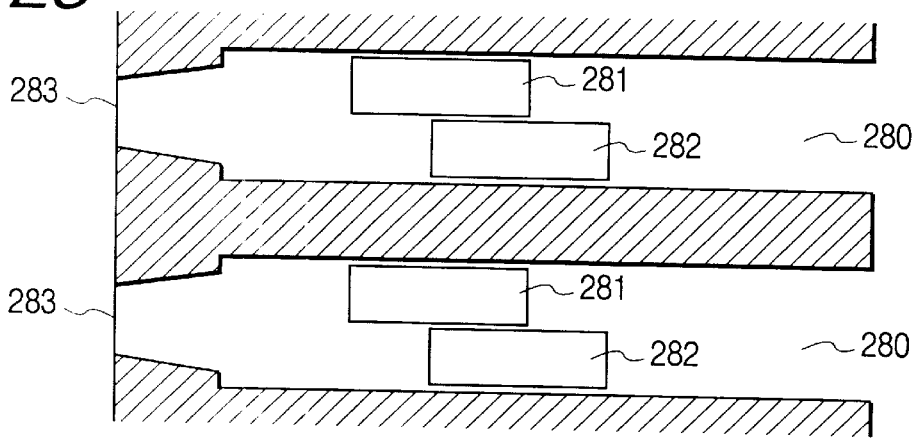
FIG. 23 is a diagram showing an example of arrangement of heaters disposed in a nozzle of an ink jet head of this embodiment.

FIG. 23 shows an example of arrangement of heaters 281 and 282 having generally the same heat generation amount disposed in the nozzle 280 at displaced positions in the horizontal direction. In this example, different ink ejection amounts (different dot diameters) can be obtained either by driving only the heater 281 near the ink ejection port 283 or by driving both the heaters 281 and 282 at the same time.

Figure 24A:
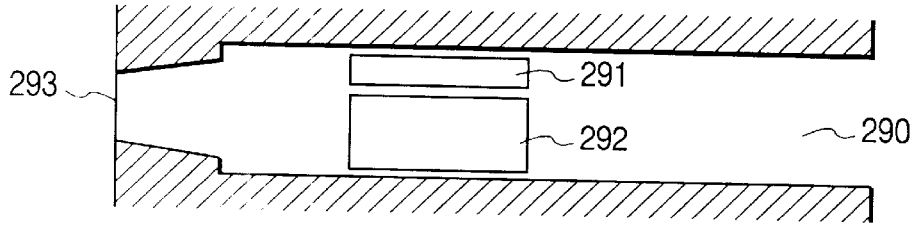
FIGS. 24A, 24B and 24C are diagrams showing examples of arrangement of heaters disposed in a nozzle of an ink jet head of this embodiment.
Figure 24B:
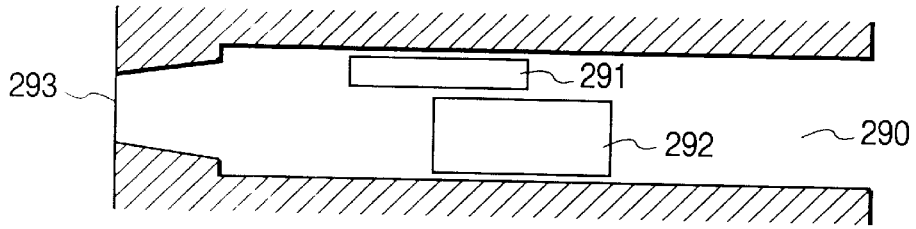
Figure 24C:
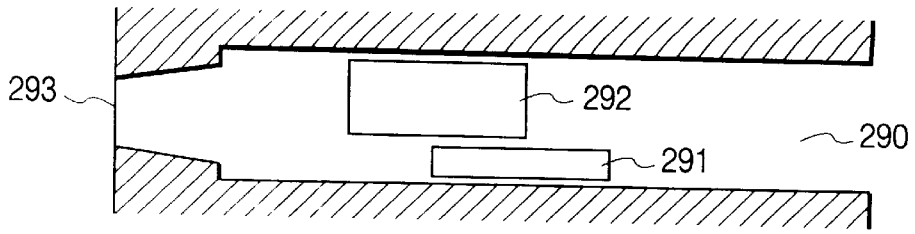

Each of the examples shown in FIGS. 24A to 24C shows an arrangement of a small heater 291 and a large heater 292 (having a larger heat generation amount) having different heat generation amounts disposed in the nozzle 290 at different positions. Also in this case, it is possible to eject from the ink ejection port 293 ink droplets having amounts suitable for recording a small dot, a middle dot and a large dot, either by driving only the small heater 291, only the large heater 292, or both the small and large heaters 291 and 292 at the same time.

Figure 25A:
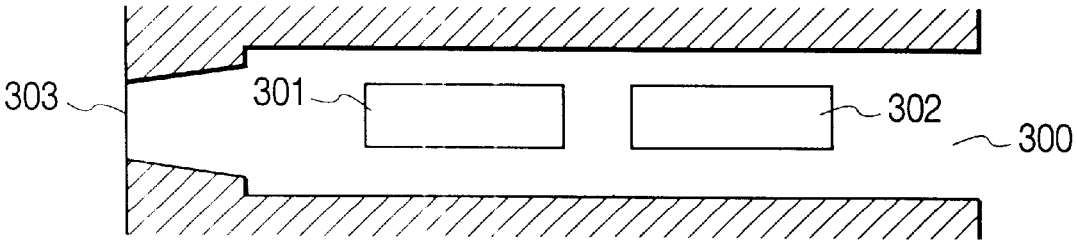
FIGS. 25A and 25B are diagrams showing examples of arrangement of heaters disposed in a nozzle of an ink jet head of this embodiment.

The example shown in FIG. 25A shows an arrangement of heaters 301 and 302 having generally the same heat generation amount disposed in the nozzle 300 sequentially in tandem toward the ejection port. Recording by two different ink ejection amounts is possible either by driving only the heater 301 or by driving both the heaters 301 and 302 at the same time.

Figure 25B:
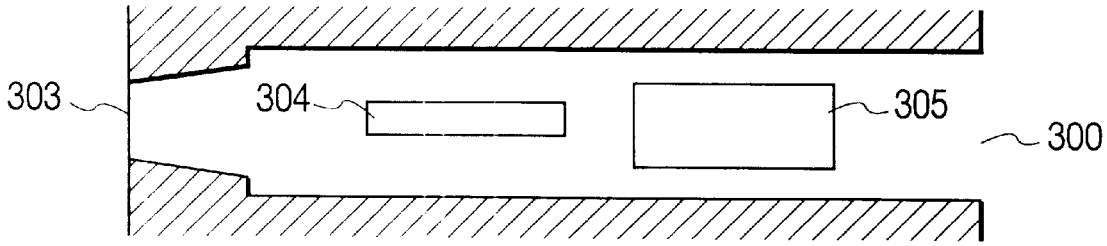

The example shown in FIG. 25B shows an arrangement of a small heater 304 and a large heater 305 having different heat generation amounts disposed in tandem toward the ejection port 303. Recording by three different ink ejection amounts is possible either by driving only the small heater 304, only the large heater 305, or both the heaters 304 and 305 at the same time.

Accordingly, by driving the heaters shown in FIGS. 23, 24A to 24C, 25A and 25B at driving timings of the heaters A and B in the first and second examples as above mentioned, an image of higher tonality may be recorded. Even in this case, as described on the second example, by causing the ejection timing of ink droplets for recording small size dots to precede that of ink droplets for recording large size dots, an image of higher tonality may be recorded.

According to the embodiment of the recording head, ink droplets of different amounts are ejected from the same ejection port of the nozzle by changing an applied impulse, and a proportional relationship between an ink ejection amount and an election speed is positively utilized. Accordingly, an ink ejection amount can be modulated by changing a displacement amount of a piezo element of the nozzle. In addition, this recording head is also advantageously applicable to other ink jet recording systems, such as recording heads and recording apparatuses using heat energy.

As to the representative constitution and principle of such ink jet recording method of forming flying liquid droplets using heat energy for the recording, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleus boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic.

As the driving signals of such pulse shape, those as disclosed in U.S. Pat. Nos. 4,463,359 and 4,345,252 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the constitution by use of U.S. Pat. No. 4,558,333 or 4,459,600 disclosing the constitution having the heat acting portion arranged in the flexed region is also included in the present invention.

In addition, the present invention can be also effectively made the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing pressure wave of heat energy correspondent to the discharging portion.

Further, as the recording head of the full line type having a length corresponding to the maximum width of a recording medium which can be recorded by the recording device, either the constitution which satisfies its length by a combination of a plurality of recording heads as disclosed in the above-mentioned specification of the constitution as one recording head integrally formed may be used.

In addition, the present invention is effective for a recording head of the freely exchangeable chip type which enables electrical connection to the main device or supply of ink from the main device by being mounted on the main device, or a recording head of the cartridge type having an ink tank integrally provided on the recording head itself.

Also, addition of a recovery means for the recording head, a preliminary auxiliary means, etc., provided for the recording head is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and it is also effective for performing stable recording to perform preliminary discharge mode which performs discharging separate from recording.

Though the ink is considered as the liquid in the embodiments as above described, another ink may be also usable which is solid below room temperature and will soften or liquefy at or above room temperature, or liquefy when a recording signal used is issued as it is common with the ink jet recording system to control the viscosity of ink to be maintained within a certain range of the stable discharge by adjusting the temperature of ink in a range from 30° C. to 70° C.

In addition, in order to avoid the temperature elevation due to heat energy by positively utilizing the heat energy as the energy for the change of state from solid to liquid, or to prevent the evaporation of ink by using the ink which will stiffen in the shelf state, the use of the ink having a property of liquefying only with the application of heat energy, such as those liquefying with the application of heat energy in accordance with a recording signal so that liquid ink is discharged, or may be solidifying at the time of arriving at the recording medium, is also applicable in the present invention. In such a case, the ink may be held as liquid or solid in recesses or through holes of a porous sheet, which is placed opposed to electricity-heat converters, as described in Japanese Laid-Open Patent Application No. 54-56847 or No. 60-71260. The film boiling method can be implemented most effectively for the inks as above cited.

Also, the present invention is applicable not only to the ink jet system using heat energy but also to the ink jet system using the piezoelectric element.

Furthermore, while the facsimile apparatus has been exemplified in this embodiment, it will be understood that the present invention is not limited thereto but also applicable to a printer connected to a host system, or a copying machine with a reader.

In the above embodiment, a recording apparatus for recording an image by scanning a recording head is used. The invention is not limited thereto, but is applicable to an apparatus of the type that a full-line type head is used and recording medium is moved relative to the head.

As described so far, the apparatus of this embodiment can record a plurality of different size dots on recording medium with a simple circuit structure, even during one path recording.

Although not provided by conventional techniques, record ratios of respective dots can be generally uniformly distributed in each scan path even if the numbers of dots of different sizes are unbalanced during the multi-path recording.

Both selection of dots and distribution of data can be performed by commonly using a thinning mask for a multi-path recording when dots are dispersed into each scan path. Therefore, the record control becomes easy.

Since a function is provided for generally uniformly dispersing dots into each scan path recording, the multi-path recording function for eliminating record variations to be caused by fluctuations of recorded dots and different dot diameters, can be efficiently used even if the numbers of large and small dots are unbalanced largely.

An average record ratio of respective nozzles during each scan path recording can be made constant and an error rate such as ejection failures at a high record ratio can be lowered. Furthermore, since the ejection amounts are continuously changed for respective nozzles, an average ink ejection amount of respective nozzles can be lowered even at a high record ratio. It is therefore possible to improve a refill frequency and an error rate. An instantaneous consumption power can also be lowered so that power cost can be reduced considerably. This power cost can be further reduced by using a power monitor or the like.

According to the embodiment, in recording an image during a relative motion of the recording head and recording medium, a small dot with a slow ejection speed is recorded before a large dot with a fast ejection speed is recorded. Accordingly, large and small dots constituting one pixel can be recorded on recording medium being superposed one upon the other generally at the same position and an image of high quality suppressing the generation of texture or the like can be formed.

As described above, according to the invention, an image having a tonal level corresponding to record data can be reproduced with high fidelity.

Further, according to the invention, the ejection amounts of ink droplets of record dots having different diameters are modulated, and record data is supplied at an ink ejection timing of the dot having a desired diameter. It is therefore possible to modulate the dot diameter during each record scan with ease and with simple circuit structure.

Still further, according to the invention, record data is modulated in accordance with modulating data so that the same data control algorithm can be used even for the multi-path recording.

Moreover, according to the invention, dots of different diameters expressing a tonal level of one pixel can be recorded without position displacement so that an image of high quality and high gradation reproductivity can be formed.

What is claimed is:

1. An ink jet recording apparatus for recording an image on a recording medium by ejecting ink from each of a plurality of ink ejection ports, comprising:

ink ejection amount changing means for changing a size of an ink droplet elected from each ink election port;

ejection pulse timing means for generating a plurality of ink ejection pulse timings, where there is ejected, during each ink ejection pulse timing, an ink droplet the size of which is changed by said ink ejection amount changing means;

modulating means for modulating record data; and control means for controlling the recording of an image on the recording medium by outputting the record data modulated by said modulating means synchronously with each corresponding ink ejection pulse timing generated by said ejection pulse timing means, wherein, during each ink election pulse timing, a size of a printed ink dot at a particular location on the recording medium is changed based on the size of the ink droplet ejected from one of the plurality of ink ejection ports.

2. An ink jet recording apparatus according to claim 1, wherein said ejection pulse timing means determines at least two ink ejection timings including an ink ejection timing for recording a larger diameter dot with the recording element and an ink ejection timing for recording a smaller diameter dot with the recording element.

3. An ink jet recording apparatus according to claim 2, wherein said ink ejection amount changing means includes a plurality of heat generating resistive members having different heat generation amounts, the heat generating resistive members being driven sequentially or at the same time.

4. An ink jet recording apparatus according to claim 3, wherein said modulating means modulates the record data in accordance with modulating data and includes storage means for storing the modulating data, wherein the modulating data is rewritable.

5. An ink jet recording apparatus according to claim 4, further comprising:

record scan data generating means for generating record data for each record scan by dividing the record data into data for each record scan and changing the divided data in accordance with the modulating data; and multi-path control means for performing recording by a plurality of record scans in accordance with the record data generated by said record scan data generating means.

6. An ink jet recording apparatus according to claim 5, wherein the recording head ejects ink by using heat energy and includes a heat energy generator for generating heat energy applied to ink.

7. An ink jet recording apparatus according to claim 3, wherein the recording head ejects ink by using heat energy and includes a heat energy generator for generating heat energy applied to ink.

8. An ink jet recording apparatus according to claim 4, wherein the recording head ejects ink by using heat energy and includes a heat energy generator for generating heat energy applied to ink.

9. An ink jet recording apparatus according to claim 2, wherein said ink ejection amount changing means includes a plurality of heat generating resistive members disposed at different positions, and changes the ink ejection amount by changing the number of heat generating resistive members driven at generally the same time or by changing the positions thereof.

10. An ink jet recording apparatus according to claim 9, wherein said modulating means modulates the record data in accordance with modulating data and includes storage means for storing the modulating data, wherein the modulating data is rewritable.

11. An ink jet recording apparatus according to claim 10, further comprising:

record scan data generating means for generating record data for each record scan by dividing the record data into data for each record scan and changing the divided data in accordance with the modulating data; and multi-path control means for performing recording by a plurality of record scans in accordance with the record data generated by said record scan data generating means.

12. An ink jet recording apparatus according to claim 11, wherein the recording head ejects ink by using heat energy and includes a heat energy generator for generating heat energy applied to ink.

13. An ink jet recording apparatus according to claim 10, wherein the recording head ejects ink by using heat energy and includes a heat energy generator for generating heat energy applied to ink.

14. An ink jet recording apparatus according to claim 9, wherein the recording head ejects ink by using heat energy and includes a heat energy generator for generating heat energy applied to ink.

15. An ink jet recording apparatus according to claim 2, wherein the recording head ejects ink by using heat energy and includes a heat energy generator for generating heat energy applied to ink.

16. An ink jet recording apparatus according to claim 2, wherein said modulating means modulates the record data in accordance with modulating data and includes storage means for storing the modulating data, wherein the modulating data is rewritable.

17. An ink jet recording apparatus according to claim 16, wherein the recording head ejects ink by using heat energy and includes a heat energy generator for generating heat energy applied to ink.

18. An ink jet recording apparatus according to claim 16, further comprising:

record scan data generating means for generating record data for each record scan by dividing the record data into data for each record scan and changing the divided data in accordance with the modulating data; and multi-path control means for performing recording by a plurality of record scans in accordance with the record data generated by said record scan data generating means.

19. An ink jet recording apparatus according to claim 2, wherein said control means controls to express a tonal level of the record data modulated by said modulating means by using a combination of larger dots, smaller dots, or both larger and smaller dots.

20. An ink jet recording apparatus according to claim 19, wherein the recording head ejects ink by using heat energy and includes a heat energy generator for generating heat energy applied to ink.

21. An ink jet recording apparatus according to claim 2, wherein said ejection pulse timing means determines the timings to record the smaller dot for a certain pixel before the larger dor for the pixel is recorded.

22. An ink jet recording apparatus according to claim 21, wherein the recording head ejects ink by using heat energy and includes a heat energy generator for generating heat energy applied to ink.

23. An ink jet recording apparatus according to claim 16, wherein the recording head ejects ink by using heat energy and includes a heat energy generator for generating heat energy applied to ink.

24. An ink jet recording apparatus according to claim 1, wherein said modulating means modulates the record data in accordance with modulating data and includes storage means for storing the modulating data, wherein the modulating data is rewritable.

25. An ink jet recording apparatus according to claim 24, further comprising:

record scan data generating means for generating record data for each record scan by dividing the record data into data for each record scan and changing the divided data in accordance with the modulating data; and multi-path control means for performing recording by a plurality of record scans in accordance with the record data generated by said record scan data generating means.

26. An ink jet recording apparatus according to claim 25, wherein the recording head ejects ink by using heat energy and includes a heat energy generator for generating heat energy applied to ink.

27. An ink jet recording apparatus according to claim 24, wherein the recording head ejects ink by using heat energy and includes a heat energy generator for generating heat energy applied to ink.

28. An ink jet recording apparatus according to claim 1, wherein the recording head ejects ink by using heat energy and includes a heat energy generator for generating heat energy applied to ink.

29. An ink jet recording method for recording an image on a recording medium by ejecting ink from each of a plurality of ink election ports, comprising the steps of:

modulating record data; and recording an image on the recording medium by outputting the record data modulated at said modulating step synchronously with an ink ejection pulse timing of one of the ink ejection ports, to eject a different size of an ink droplet, wherein, during each ink ejection pulse timing, a size of a printed ink dot at a particular location on the recording medium is changed based on the size of the ink droplet ejected from one of the plurality of ink ejection ports.

30. An ink jet recording method according to claim 29, wherein the ink ejection timing includes at least two ink ejection timings including an ink ejection timing for recording a larger diameter dot with the recording element and an ink ejection timing for recording a smaller diameter dot with the recording element.

31. An ink jet recording method according to claim 30, wherein the ink ejection amount of the recording head is changed by a plurality of heat generating resistive members having different heat generation amounts or disposed at different positions, or by changing the number or positions of heat generating resistive members driven at generally the same time, or by changing the positions thereof.

32. An ink jet recording method according to claim 31, wherein said modulating step modulates the record data in accordance with modulating data and includes a memory for storing the modulating data, wherein the modulating data is rewritable.

33. An ink jet recording method according to claim 31, wherein a tonal level of the record data modulated at said modulating step is expressed by using a combination of larger dots, smaller dots, or both larger and smaller dots.

34. An ink jet recording method according to claim 32, further comprising the steps of:

generating record data for each record scan by dividing the record data into data for each record scan and changing the divided data in accordance with the modulating data; and performing recording by a plurality of record scans in accordance with the record data generated at said record scan data generating step.

35. An ink jet recording method according to claim 30, wherein said modulating step modulates the record data in accordance with modulating data and includes a memory for storing the modulating data, wherein the modulating data is rewritable.

36. An ink jet recording method according to claim 35, further comprising the steps of:

generating record data for each record scan by dividing the record data into data for each record scan and changing the divided data in accordance with the modulating data; and performing recording by a plurality of record scans in accordance with the record data generated at said record scan data generating step.

37. An ink jet recording method according to claim 30, wherein as the ink ejection timing, the smaller dot for a certain pixel is recorded with the recording element before the larger dot for the pixel is recorded.

38. An ink jet recording method according to claim 29, wherein said modulating step modulates the record data in accordance with modulating data and includes a memory for storing the modulating data, wherein the modulating data is rewritable.

39. An ink jet recording method according to claim 38, further comprising the steps of:

generating record data for each record scan by dividing the record data into data for each record scan and changing the divided data in accordance with the modulating data; and performing recording by a plurality of record scans in accordance with the record data generated at said record scan data generating step.

40. An ink jet recording apparatus for recording a pixel with a recording head having a plurality of ink ejection ports by recording a plurality of dots, comprising:

driving means provided in correspondence with the ink ejection ports for sequentially ejecting, at predetermined timings, at least two inks among a plurality of inks to form a plurality of dots constituting the pixel, from the ink ejection ports of the recording head;

changing means for changing a size of an ink droplet of each of the at least two inks sequentially ejected from the ink ejection ports by the driving means at the predetermined timings; and output means for outputting, time sequentially and synchronously with the predetermined timings, data for ejecting ink which forms the pixel and which contains information of a size of an ink droplet to be ejected from each of the plurality of ink ejection ports in an ink output order.

41. An ink jet recording apparatus according to claim 40, wherein said changing means changes the ejection amounts of at least two inks in order to form a larger diameter dot and a smaller diameter dot.

42. An ink jet recording apparatus according to claim 41, wherein at the ink ejection port, a plurality of heat generating resistive members disposed at different positions are provided, and said changing means drives the plurality of heat generating resistive members by changing the number or positions thereof at the predetermined timings.

43. An ink jet recording apparatus according to claim 41, wherein at the ink ejection port, a plurality of heat generating resistive members having different heat generation amounts are provided, and said changing means drives the plurality of heat generating resistive members sequentially or at the same time at the predetermined timings.

44. An ink jet recording apparatus according to claim 41, wherein said changing means changes the ejection amounts of at least two inks to be ejected sequentially at the predetermined timings so as to record the smaller dot for a certain pixel before the larger dot for the pixel is recorded.

45. An ink jet recording apparatus for recording a pixel formed by a plurality of dots by ejecting ink from an ink ejection port, comprising:

driving means for sequentially ejecting, at predetermined timings, at least two inks among a plurality of inks to form a plurality of dots constituting the pixel, from the ink ejection port;

changing means for changing a size of an ink droplet of each of the at least two inks sequentially ejected from the ink ejection port by the driving means at each of the predetermined timings; and output means for outputting, time sequentially and synchronously with the predetermined timings, data for ejecting ink which forms the pixel and which contains information of a size of an ink droplet to be ejected from the ink ejection port in an ink output order.

46. An ink jet recording apparatus according to claim 45, wherein said changing means changes the ejection amounts of at least two inks in order to form a larger diameter dot and a smaller diameter dot.

47. An ink jet recording apparatus according to claim 46, wherein at the ink ejection port, a plurality of heat generating resistive members having different heat generation amounts are provided, and said changing means drives the plurality of heat generating resistive members sequentially or at the same time at the predetermined timings.

48. An ink jet recording apparatus according to claim 46, wherein at the ink ejection port, a plurality of heat generating resistive members disposed at different positions are provided, and said changing means drives the plurality of heat generating resistive members by changing the number or positions thereof at the predetermined timings.

49. An ink jet recording apparatus according to claim 46, wherein said changing means changes the ejection amounts of at least two inks ejected sequentially at the predetermined timings so as to record the smaller dot for a certain pixel before the larger dot for the pixel is recorded.

50. An ink jet recording method for recording a pixel with a recording head having a plurality of ink ejection ports by recording a plurality of dots, comprising the steps of:

sequentially ejecting, at predetermined timings, at least two inks among a plurality of inks to form a plurality of dots constituting the pixel, from the ink ejection ports of the recording head;

changing a size of an ink droplet of each of the at least two inks sequentially ejected from the ink ejection ports at the predetermined timings; and outputting, time sequentially and synchronously with the predetermined timings, data for ejecting ink which forms the pixel and which contains information of a size of an ink droplet to be ejected from each of the plurality of ink ejection ports in an ink output order.

51. An ink jet recording method according to claim 50, wherein said changing step changes the ejection amounts of at least two inks in order to form a larger diameter dot and a smaller diameter dot.

52. An ink jet recording method according to claim 51, wherein at the ink ejection port, a plurality of heat generating resistive members having different heat generation amounts are provided, and said changing step drives the plurality of heat generating resistive members sequentially or at the same time at the predetermined timings.

53. An ink jet recording method according to claim 51, wherein at the ink ejection port, a plurality of heat generating resistive members disposed at different positions are provided, and said changing step drives the plurality of heat generating resistive members by changing the number or positions thereof at the predetermined timings.

54. An ink jet recording method according to claim 51, wherein said changing step changes the ejection amounts of at least two inks to be ejected sequentially at the predetermined timings so as to record the smaller dot for a certain pixel before the larger dot for the pixel is recorded.

* * * * *

UNITED STATES PATENT AND TRADEMARK OFFICE

CERTIFICATE OF CORRECTION

PATENT NO. : 6,283,569 B1
DATED : September 4, 2001
INVENTOR(S) : Naoji Otsuka et al.

It is certified that error appears in the above-identified patent and that said Letters Patent is hereby corrected as shown below:

Drawings,
Figure 19, Sheet 18, "PIXELES" should read -- PIXELS --.

Column 5,
Line 16, "22C show" should read -- 22E show --.

Column 16,
Line 41, "election" should read -- ejection --.

Column 21,
Line 11, "16," should read -- 1, --.

Column 22,
Line 44, "38," should read -- 32, --.

Signed and Sealed this

Twenty-third Day of July, 2002

*Attest:*

*Attesting Officer*

JAMES E. ROGAN
*Director of the United States Patent and Trademark Office*